US011059666B2

(12) United States Patent
Lanigan et al.

(10) Patent No.: US 11,059,666 B2
(45) Date of Patent: Jul. 13, 2021

(54) LARGE-CAPACITY MODULAR HOLDING CONTAINER AND RELATED METHODS

(71) Applicant: NEWPARK MATS & INTEGRATED SERVICES LLC, The Woodlands, TX (US)

(72) Inventors: Matthew Stephen James Lanigan, The Woodlands, TX (US); Richard Brennan, Coraopolis, PA (US); Gaurav Agrawal, Katy, TX (US); James Kerwin McDowell, Lafayette, LA (US)

(73) Assignee: NEWPARK MATS & INTEGRATED SERVICES LLC, The Woodlands, TX (US)

( * ) Notice: Subject to any disclaimer, the term of this patent is extended or adjusted under 35 U.S.C. 154(b) by 0 days.

(21) Appl. No.: 16/217,866

(22) Filed: Dec. 12, 2018

(65) Prior Publication Data

US 2019/0185260 A1 Jun. 20, 2019

Related U.S. Application Data

(60) Provisional application No. 62/598,858, filed on Dec. 14, 2017.

(51) Int. Cl.
*B65D 90/08* (2006.01)
*B65D 90/20* (2006.01)
(Continued)

(52) U.S. Cl.
CPC ..... *B65D 90/08* (2013.01); *B65D 88/08* (2013.01); *B65D 88/528* (2013.01); *B65D 88/76* (2013.01);
(Continued)

(58) Field of Classification Search
CPC .... B65D 90/205; B65D 90/08; B65D 90/024; B65D 90/028; B65D 88/08; B65D 88/528; B65D 88/76
(Continued)

(56) References Cited

U.S. PATENT DOCUMENTS 854,537 A * 5/1907 Simon ..... B65D 90/205 220/4.16
4,989,751 A 2/1991 Gillett
(Continued)

FOREIGN PATENT DOCUMENTS

JP 09110087 A 4/1997
JP 2000079984 A 3/2000
(Continued)

OTHER PUBLICATIONS

Above Ground Storage Tanks, Mustang Extreme Environmental Services, https://www.mustangextreme.com/our-services/above-ground-storage-tanks/, © 2018 Mustang Extreme Environmental Services, 4pp.
(Continued)

*Primary Examiner* — Stephen J Castellano
(74) *Attorney, Agent, or Firm* — Cantor Colburn LLP

(57) ABSTRACT

A holding container includes a plurality of pre-formed, releasably interlocking, load-bearing panels configured to form an at least partially curved, load-bearing wall extending around the perimeter of at least one storage area capable of containing at least 100,000 gallons of liquids, solids or a combination thereof. At least one among the width and length of each panel is less than 102 inches in a non-load-bearing state.

11 Claims, 18 Drawing Sheets

(51) Int. Cl.

| | |
|---|---|
| ***B65D 88/08*** | (2006.01) |
| ***B65D 88/52*** | (2006.01) |
| ***B65D 88/76*** | (2006.01) |
| ***B65D 90/02*** | (2019.01) |

(52) U.S. Cl.
CPC ..... *B65D 90/024* (2013.01); *B65D 90/028* (2013.01); *B65D 90/205* (2013.01)

(58) Field of Classification Search
USPC ..... 220/4.17
See application file for complete search history.

(56) References Cited

U.S. PATENT DOCUMENTS

| | | | | |
|---|---|---|---|---|
| 9,409,707 | B2 * | 8/2016 | Perkins | B65D 90/023 |
| 2013/0186890 | A1 * | 7/2013 | Moody | B65D 88/005 220/4.16 |
| 2013/0292391 | A1 | 11/2013 | Dala | |
| 2014/0105686 | A1 * | 4/2014 | Southworth | B65D 90/046 405/107 |
| 2015/0076141 | A1 * | 3/2015 | Noles, Jr. | B65D 90/205 220/4.16 |

FOREIGN PATENT DOCUMENTS

| | | | |
|---|---|---|---|
| JP | 2010275852 | A | 12/2010 |
| KR | 100841570 | B1 | 6/2008 |

OTHER PUBLICATIONS

Above-Ground Storage, Rockwater Energy Solutions, http://www.rockwaterenergy.com/wp-content/uploads/2016/01/AST-Overview-2015-09-21.pdf, © 2015 Rockwater Energy Solutions, Inc., 2 pp.

Rockwater Above Ground Storage Tank Setup, Rockwater Energy Solutions, YouTube video 1:17 minutes, https://www.youtube.com/watch?v=ISy_z-TpcO0, Published on Oct. 26, 2015, 1pp.

* cited by examiner

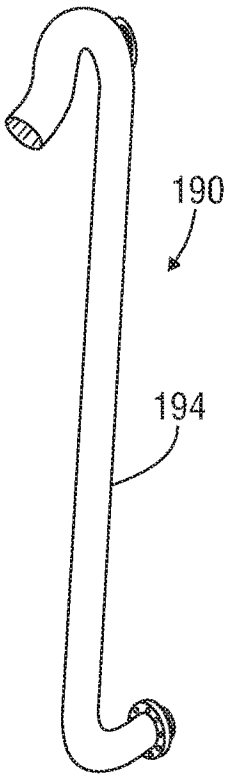
FIG. 19
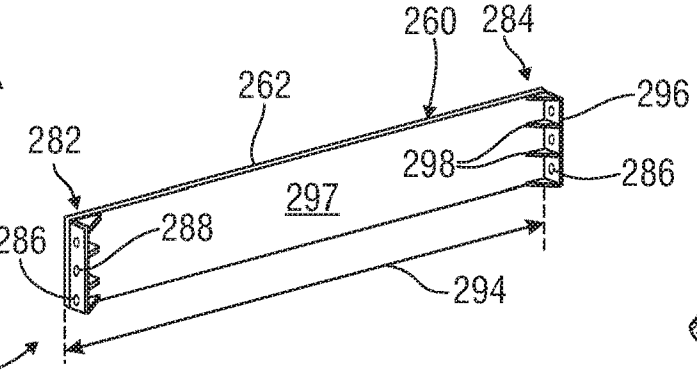
FIG. 15
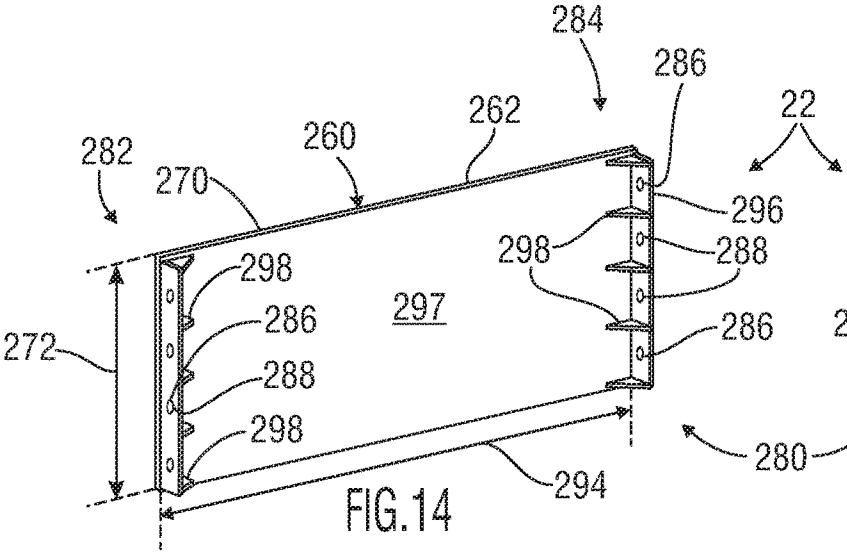
FIG. 14
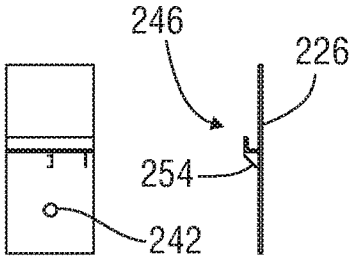
FIG. 18B
FIG. 18A
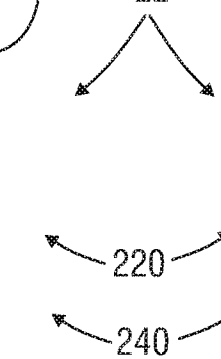
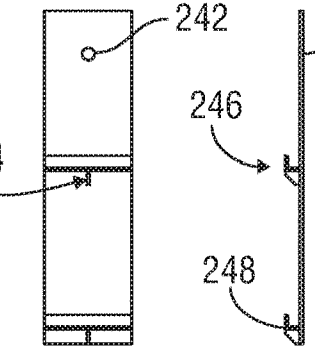
FIG. 17B
FIG. 17A
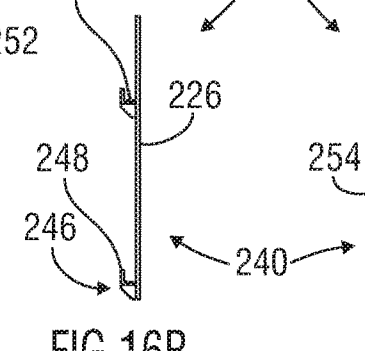
FIG. 16B
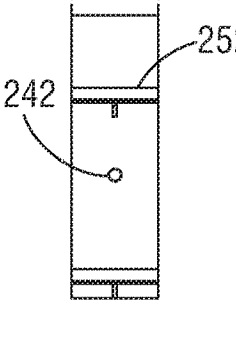
FIG. 16A 10
150
170
12a
148
13
170
40
23b 12
12b
48
22
20
19
305
308
14
319
274
32a
168
26
17
266
313
318
262
240
130
14
292
220
300
14
304
260

262
240
285
300
20
23a 280
262
296
290
292
293
309
27
288
304
262
308
14
305

168
150
274
262
14
300
309
246
220
172
260
240
170
200
204
293
292
290
304

LARGE-CAPACITY MODULAR HOLDING CONTAINER AND RELATED METHODS

The present application claims priority to U.S. Provisional Patent Application Ser. No. 62/598,858 filed on Dec. 14, 2017 and entitled "Above-Ground Storage Tank and Related Methods", which is hereby incorporated by reference herein in its entirety.

FIELD OF THE DISCLOSURE

The present disclosure relates generally to large-capacity holding containers and related methods.

BACKGROUND

Large-capacity holding containers (e.g. above-ground storage tanks (AST), below ground tanks, etc.) are useful in a myriad of industries and applications. For example, temporary, or semi-permanent, large-capacity holding containers are used at various different work sites, such as at oilfield or hydrocarbon well exploration and production sites (e.g. hydraulic fracturing job sites), construction, pipeline, mining, chemical production, disaster response sites and other locations for storing liquid, solids or a combination thereof.

Currently known large-capacity holding container solutions are believed to have one or more of the following and/or other disadvantages: are costly and time-consuming to manufacture, transport, assemble and/or disassemble; require the use of permitted-load transportation to the installation site; involve the use of special components that cannot be procured or fabricated locally (near installation sites); require the use of heavy (e.g. large, curved, steel) wall components which are cumbersome and difficult to handle; do not use wall components that can be used for other purposes; are not scalable; have a fixed, inflexible installation footprint, size and overall shape; do not use modular or interchangeable components for easy variation in holding container sizing, shaping and footprint on site or at subsequent redeployments; if buried at least partially underground, are not able to resist microbial or biological degredaton or degredation due to the alkalinity of the earth.

It should be understood that the above-described examples, disadvantages, features and capabilities are provided for illustrative purposes only and are not intended to limit the scope or subject matter of this disclosure or the appended claims. Thus, none of the appended claims should be limited by the above discussion or construed to address, include or exclude each or any of the above-cited examples, disadvantages, features and capabilities merely because of the mention thereof herein.

Accordingly, there exists a need for improved systems, articles and methods useful for storing fluids, solids or a combination thereof having one or more of the attributes or capabilities described or shown in, or as may be apparent from, the other portions of this patent application.

BRIEF SUMMARY OF THE DISCLOSURE

In some embodiments, the present disclosure involves a holding container having an at least partially curved, load-bearing wall extending around the perimeter of at least one storage area capable of containing at least 100,000 gallons of liquids, solids or a combination thereof. A plurality of pre-formed, releasably interlocking, load-bearing panels is configured to form the at least partially curved, load-bearing wall. Each panel is originally formed flat. At least one among the width and length of each panel is less than 102" in a non-load-bearing state.

If desired, the panels may be at least partially hollow and/or each panel may be elastic and able to flex into a curved shape during use of the holding container. In at least some instances, the panels may be configured to form a continuous wall, wherein the shape of the continuous wall includes at least three distinct, least partially linear sides and a corner between each side. At least one of the corners may be curvilinear. If desired, the panels may be modular and reusable to form at least partially curved, load-bearing, holding container walls and holding containers having different sizes and containment capacities. In some embodiments, at least one horizontally-extending connector configured to be coupled between and/or around adjacent panels may be included. Each horizontally-extending connector may be rigid or flexible and configured to assist in allowing the panels to form the curved portion(s) of the wall. The horizontally-extending connectors may be configured to assist in retaining the panels in interlocking engagement and supporting the load applied to the panels by contents of the storage area(s) during use of the holding container.

In at least some instances, the wall may be buried at least partially underground and the material composition of the panels may render them resistant to microbial and biological degredaton and degredation due to the alkalinity of the earth. If desired, the panels may be constructed of one or more composites including at least one among plastic, plastic derivatives, wood and wood derivatives. Each panel may include a main body having a thickness and and at least one lip extending outwardly therefrom. The lip(s) may having a thickness that is less than the thickness of the main body. A lip of each panel may be configured to overlap and be releasably secured to another panel to interlock the panels together. When the panels are interlocked, each panel may overlap each adjacent panel across at least 5% of the smaller of its width and length.

If desired, the panels may be configured to be coupled together in a manner that allows each panel to move side-to-side and up-and-down independently or in unison with one or more other panels in response to variations in the substrate below the panels and/or loads applied to the panels by contents of the storage area(s) without damaging or disengaging the panels or degrading the panels' strength characteristics or the holding container's ability to contain the contents of the storage area(s). At least one liquid-impermeable surface (e.g. one or more liners, geotextiles, coatings and/or spongy materials) may be disposed at least partially around the storage area inside the wall and configured to prevent the contents of the storage area(s) from escaping out of the holding container. When the panels are interlocked to form the wall, at least one joint may be formed between adjacent interlocked panels and, in at least some instances, the liquid-impermeable surface(s) may extend only along at least some of the joints on the inside of the wall. If desired, the size of the holding container may be varied during installation thereof at the container installation site in increments of one or more panels.

In various embodiments, the present disclosure includes a holding container capable of containing at least 100,000 gallons of liquids, solids or a combination thereof in at least one storage area. A wall formed of a plurality of upright panels extends around the perimeter of the storage area(s) to contain at least 100,000 gallons of liquids, solids or a combination therein. A plurality of connectors is associated with the panels and at least one water impermeable surface is disposed at least partially around the storage are. At least 10% of any combination of the panels, connectors and water impermeable surface(s) is constructed of non-metallic material.

Some embodiments involve methods of forming a holding container capable of containing at least 100,000 gallons of liquids, solids or a combination thereof within at least one storage area. These methods include releasably interconnecting at least some of a plurality of upright, pre-formed, load-bearing panels to form an at least partially curved, load-bearing first wall around the perimeter of the storage area(s) to contain at least 100,000 gallons of liquids, solids or a combination in the storage area(s). Each panel is originally formed flat and at least one among the width and the length of each panel is less than 102" in a non-load-bearing state.

If desired, other among the plurality of panels may be positioned and releasably interconnected in an upright orientation around the perimeter of the first wall to form an at least partially curved, load-bearing second wall around the first wall and a nested pair of holding containers. In at least some instances, the panels may be at least partially buried underground and capable of resisting microbial and biological degredaton and degredation due to the alkalinity of the earth. If desired, any one or more of the plurality of panels may be melted, ground, crushed or cut apart to form recyclable panel material useful to form one or more new panels and/or other components having the same properties, characteristics and capabilities as the plurality of panels.

Each panel may include a main body and at least one lip extending outwardly therefrom and having a thickness that is less than the thickness of the main body. A first lip of each panel may overlap another panel so that each panel overlaps each adjacent panel across at least 5% of the smaller of its width and length. The fist lip of each panel may be releasably interlocked with the adjacent panel. If desired, the panels may be interlocked together in a manner that allows the panels to move side-to-side and up-and-down in response to variations in the substrate below the panels and/or loads applied to the panels by contents of the storage area(s) without damaging or disengaging the panels or degrading the panels' strength characteristics or the first wall's ability to contain the contents of the storage area(s). At least some of the panels may flex into a curved shape during use of the holding container.

In at least some instances, the size and/or shape of the first wall may be determined at least partially by the number of panels interconnected to form the first wall. In such instances, the size and/or shape of the first wall may be varied during formation of the first wall by increasing or decreasing the quantity of panels used to form the first wall. If desired, the wall may be disassembled, at least some of the disassembled panels positioned in an upright, side-by-side orientation and releasably interconnecting to form another at least partially curved, load-bearing wall around the perimeter of one or more storage area(s) to serve as another holding container capable of containing a different volume of at least 100,000 gallons of liquids, solids or a combination thereof as compared to the storage area(s) contained within the first wall, the newly formed wall having a different size and/or shape as compared to the first wall.

If the panels are re-usable as ground covers, the method(s) may include disassembling the first wall and laying one or more of the panels used to form the first wall horizontally on the ground to form a support surface capable of supporting the weight of personnel, equipment and vehicles, including bulldozers, bucket-loaders, water and fuel tanker trucks and semi-trailer trucks, thereupon and moving thereacross. If desired, the support surface may be disassembled and at least some of the disassembled panels positioned in an upright, side-by-side orientation and releasably interconnected to form an at least partially curved, load-bearing wall around the perimeter of one or more storage area(s) to serve as another holding container to contain at least 100,000 gallons of liquids, solids or a combination thereof.

Accordingly, the present disclosure includes features and advantages which are believed to enable it to advance large-capacity holding container technology. Characteristics and advantages of the present disclosure described above and additional features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein:

FIG. 14 is a perspective view of an exemplary horizontally-extending connector in accordance with one or more embodiments of the present disclosure;

FIG. 15 is a perspective view of another exemplary horizontally-extending connector in accordance with one or more embodiments of the present disclosure;

FIG. 16A is a front view of an exemplary attachment bracket in accordance with one or more embodiments of the present disclosure;

FIG. 16B is a side view of the exemplary attachment bracket shown in FIG. 16A;

FIG. 17A is a front view of another exemplary attachment bracket in accordance with one or more embodiments of the present disclosure;

FIG. 17B is a side view of the exemplary attachment bracket shown in FIG. 17A;

FIG. 18A is a front view of another exemplary attachment bracket in accordance with one or more embodiments of the present disclosure;

FIG. 18B is a side view of the exemplary attachment bracket shown in FIG. 18A;

FIG. 19 is a perspective view of an exemplary fill tube in accordance with one or more embodiments of the present disclosure;

DETAILED DESCRIPTION OF PRESENTLY PREFERRED EMBODIMENTS

Figure 1:
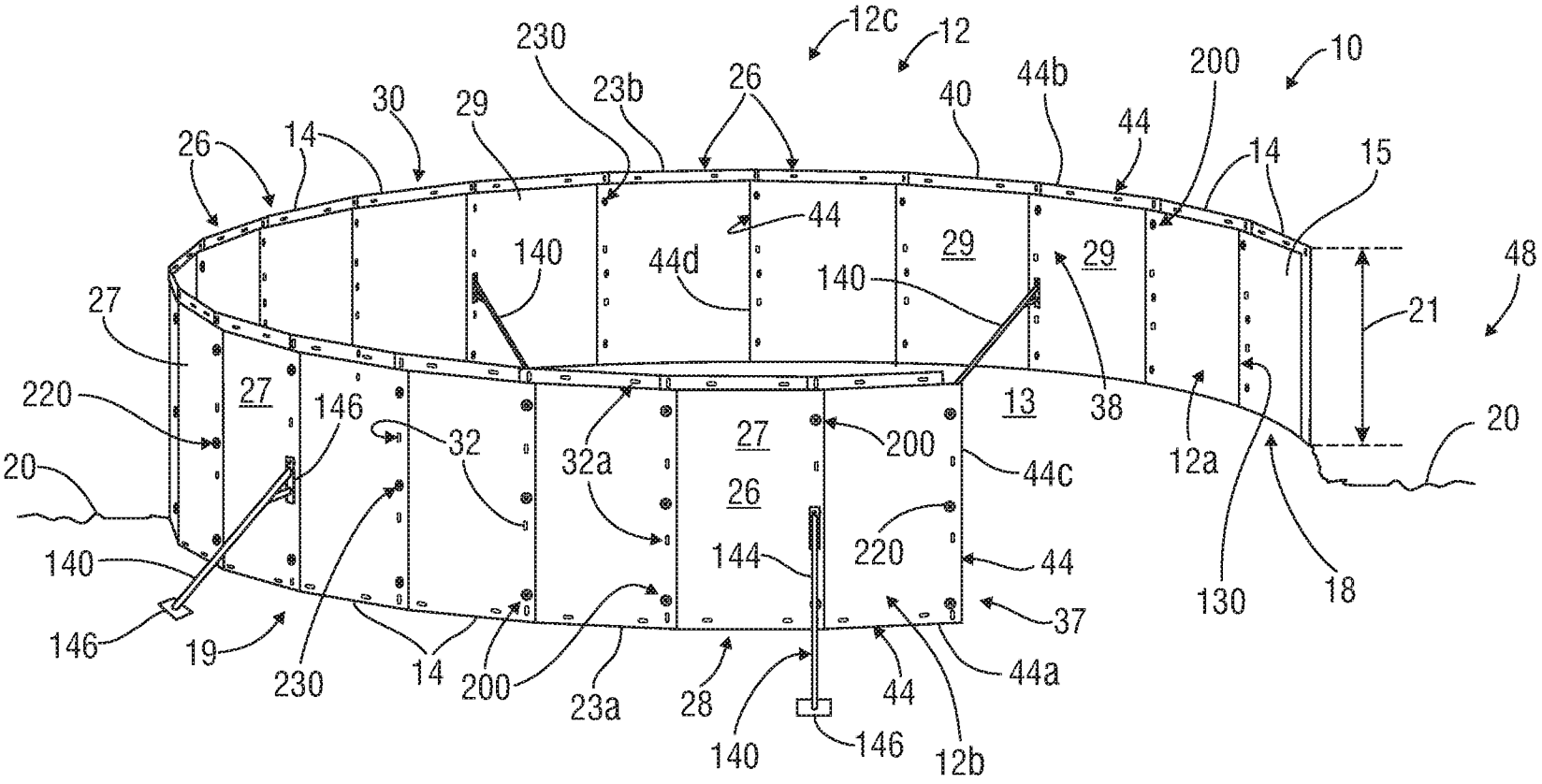
FIG. 1 is a perspective view showing installation of an exemplary large-capacity, modular, holding container in accordance with one or more embodiments of the present disclosure.

Characteristics and advantages of the present disclosure and additional features and benefits will be readily apparent to those skilled in the art upon consideration of the following detailed description of exemplary embodiments and/or referring to the accompanying figures. It should be understood that the description herein and appended drawings, being of example embodiments, are not intended to limit the claims of this patent or any patent or patent application claiming priority hereto. On the contrary, the intention is to cover all modifications, equivalents and alternatives falling within the spirit and scope of this disclosure and the appended claims. Many changes may be made to the particular embodiments and details disclosed herein without departing from such spirit and scope.

In showing and describing preferred embodiments in the appended figures, common or similar elements are referenced with like or identical reference numerals or are apparent from the figures and/or the description herein. The figures are not necessarily to scale and certain features and certain views of the figures may be shown exaggerated in scale or in schematic in the interest of clarity and conciseness.

As used herein and throughout various portions (and headings) of this patent (including the claims), the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference.

Certain terms are used herein and in the appended claims to refer to particular components. As one skilled in the art will appreciate, different persons may refer to a component by different names. Further, this document does not intend to distinguish between components that differ in name but not function. Also, the terms "including" and "comprising" are used herein and in the appended claims in an open-ended fashion, and thus should be interpreted to mean "including, but not limited to . . . ". Further, reference herein and in the appended claims to components, feature, actions, aspects, etc. in a singular tense does not limit the present disclosure or appended claims to only one such component feature, action, aspect, etc., but should be interpreted to mean one or more, except and only to the extent as may be expressly limited otherwise herein or in a particular claim hereof and only for such claim(s) and any claim(s) depending therefrom As used herein and in the appended claims, the following terms have the following meanings, except and only to the extent as may be expressly specified differently in a particular claim hereof and only for such claim(s) and any claim(s) depending therefrom:

The term "and/or" as used herein provides for three distinct possibilities: one, the other or both. All three possibilities do not need to be available—only any one of the three. For example, if a component is described as "having a collar and/or a sleeve", some embodiments may include a collar, some embodiments may include a sleeve and some embodiments may include both. Since the use of "and/or" herein does not require all three possibilities, a claim limitation herein that recites "having a collar and/or a sleeve" would be literally infringed by a device including only one or more collars, one or more sleeves or both one or more sleeves and one or more collars.

The terms "coupled", "connected" and the like, and variations thereof, as used herein mean either an indirect or direct connection or engagement, except and only to the extent as may be expressly recited and explicitly required in a particular claim hereof and only for such claim(s) and any claim(s) depending therefrom. Thus, if a first device couples to a second device, that connection may be through a direct connection, or through an indirect connection via other devices and connections, except and only to the extent as may be expressly recited and explicitly required otherwise herein or in a particular claim hereof and only for such claim(s) and any claim(s) depending therefrom.

The terms "edge" and variations thereof mean one or more surfaces extending along a linear path (a straight or nearly straight line), or along a path having curves or turns.

The terms "elongated" and variations thereof as used herein mean, include and refer to an item having an overall length that is greater than its average width.

The terms "generally", "substantially" and variations thereof as used herein mean and include (i) completely, or 100%, of the referenced parameter, variable, value, event etc. and (ii) a range of values less than 100% based upon the typical, normal or expected degree of variation or error for the referenced parameter, variable, value, event, etc. in the context of the particular embodiment or use thereof, such as, for example, 90-100%, 95-100% or 98-100%.

The terms "geometrically-aligned" and variations thereof in reference to multiple sheets of a ground cover or panel mean that that the outer side edges extending along each respective side of one item are at least substantially parallel to the outer side edges of the respective corresponding sides of the other item(s).

The terms "ground" and variations thereof mean the substrate, such as the earth's surface or other location (e.g. an underground location), any material(s), liquid (including waterways and bodies of water), other surface(s), structure(s), area(s), component(s) or a combination thereof, upon which a holding container is installed or erected.

The term "ground cover" is the name for and refers to a section of material that is useful to at least partially cover an area (on the ground or other surface), constructed of any desired material and capable of supporting a desired load.

The terms "large-capacity" and variations thereof means capable of holding or containing at least 100,000 gallons of liquid, solids or a combination thereof.

The terms "load" and variations thereof mean, refer to and include any one or more among the pressure, forces, load, effective stress and weight bearing upon an item or component, such as, for example, the pressure, forces, load, effective stress, weight (or a combination thereof) of the contents of the storage area(s) bearing or acting upon one or more panels and/or support system of a holding container.

The terms "modular" and variations thereof as used herein, particularly in relation to the holding containers, means employing one or more construction elements (e.g. panels, braces, connectors, brackets) that are reusable and allow flexibility as to configuration and overall shape, or footprint, and scalability of the resulting structure or assemblage at any particular installation site and/or through repetitive use of the construction elements. The use of the term "modular" and variations thereof in relation to individual components (e.g. panels, braces, connectors, brackets) means offering one or more of those benefits.

The terms "overlapping" and variations thereof mean that one of the referenced items rests upon and covers at least part of the other referenced item(s).

The terms "panel" is the name for and refers to a section of material constructed of any desired material and capable of supporting a desired or expected load placed upon either, or both, of the opposing faces thereof without undesirable deformation, cracking, breaking, or otherwise failing.

The terms "planar" and "flat", when used in reference to a panel, mean that the entirety of the panel generally extends in one or multiple parallel planes and the panel (or main body thereof) is substantially flat when originally constructed.

Any component identified as a "plate" herein includes, but is not limited to, a plate as that term is commonly understood (e.g. a thin, flat sheet or strip of metal or other material, typically used to join or strengthen things or forming part of a machine), and may have non-planar surfaces or construction, may not be thin per se, may have any other form suitable for use in the particular configuration in which it is used (e.g. may be a curved or curvilinear-shaped member), may be comprised of multiple parts or a combination thereof.

The terms "receptacle" and variations thereof means a hole, cut-out, cavity, notch, orifice or passageway formed in a panel (or ground cover) or any other desired mechanism(s) (e.g. ring, clip, bracket, mating portion) coupled to, embedded in or extending from the panel (or ground cover) and useful for connecting it with one or more other components.

The terms "rigidly coupled" and variations thereof as used herein mean connected together in a manner that is intended not to allow any, or more than an insubstantial or minimal amount of, relative movement therebetween during typical or expected operations. In other words, if components A and B are rigidly coupled together, they are not movable relative to one another (more than a minimal or insubstantial amount) during typical or expected use scenarios.

The terms "stepped-configuration" and variations in the context of a panel or ground cover mean that the item has at least one portion (e.g. upper lip) that extends at least partially on a different plane than at least one other portion (e.g. lower lip), and the planes are at least substantially parallel.

The terms "upright", "vertical", "vertically-oriented" and variations thereof as used herein mean and include oriented perfectly or substantially vertically, angularly relative to a vertical axis or non-horizontally.

It should be noted that any of the above terms may be further explained, defined, expanded or limited below or in other sections of this patent. Further, the above list of terms is not all inclusive and other terms may be defined or explained below or in other sections of this patent.

Referring initially to FIG. 1, a large-capacity holding container 10 in accordance with an embodiment of the present disclosure is shown. The exemplary holding container 10 includes at least one wall 12 constructed at least partially of multiple interconnected panels 14 arranged generally side-by-side in an upright orientation on the ground (or other substrate) 20. The illustrated wall 12 surrounds at least one storage area 13 useful for containing any desired contents, such as liquid 17 (e.g. water, dirty water, hydraulic fracturing flow-back/produced water, FIG. 13A), solids, such as natural products (e.g. grains), sand or silica-based material (e.g. hydraulic fracturing proppant), naturally mined materials, garbage, debris, contaminated waste, any other material or a combination thereof. The present disclosure and appended claims are in no way limited by the nature of the contents of the storage area(s) 13, except and only to the extent as may be expressly recited and explicitly required in a particular claim hereof and only for such claim(s) and any claim(s) depending therefrom.

Figure 33:
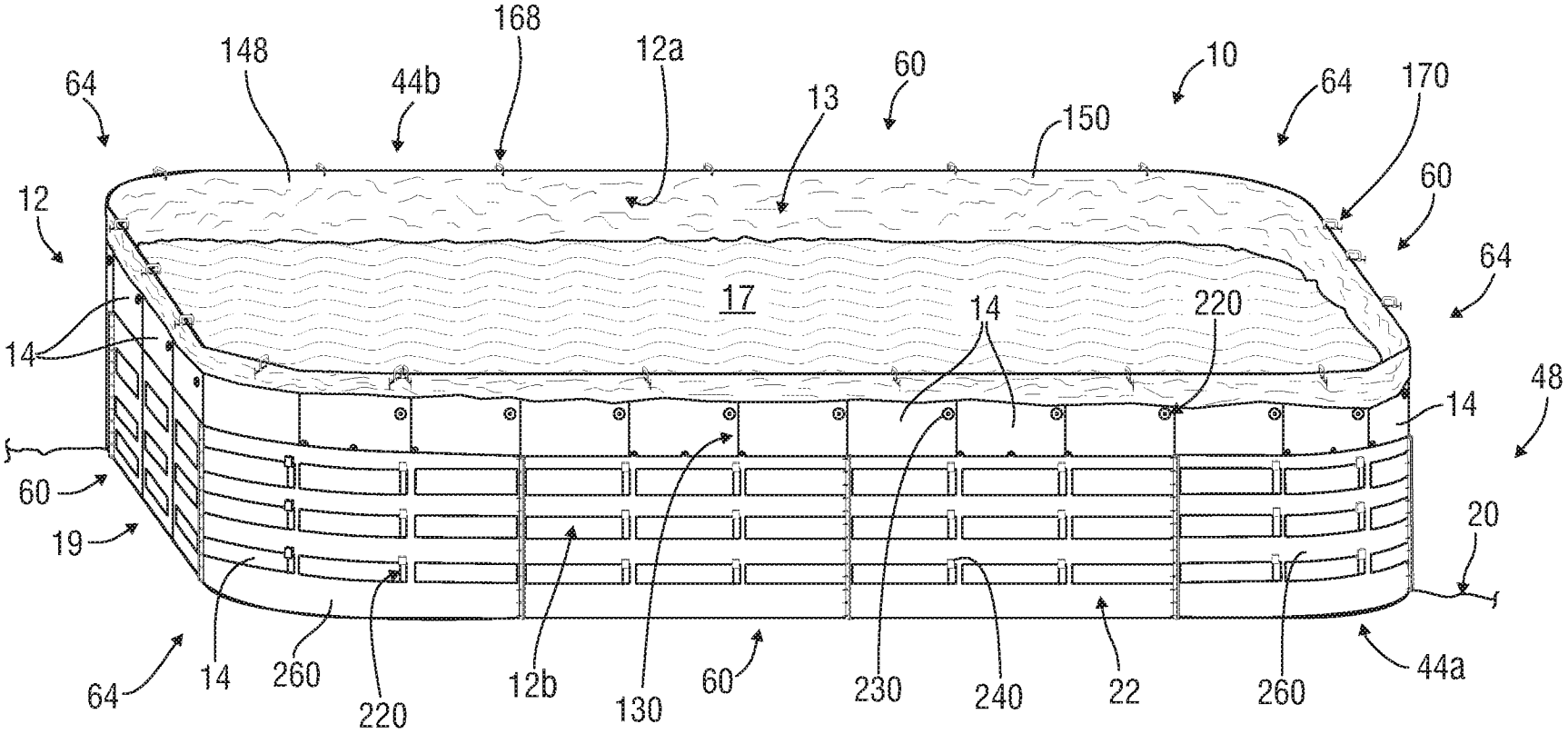
FIG. 33 is a perspective view of an exemplary large-capacity, modular, holding container formed in a configuration having at least one at least partially linear side and at least one curvilinear corner in accordance with one or more embodiments of the present disclosure.

In the preferred embodiment, the wall 12 is load-bearing, at least partially curved, extends around the perimeter of storage area(s) 13 (e.g. is continuous) and capable of containing, holding or surrounding at least 100,000 gallons of liquids, solids or a combination thereof. While the illustrated wall 12 has an overall circular shape or configuration, the wall 12 may instead be formed with multiple distinct sides and corners formed between each pair of sides. If desired, at least one of the sides of the configuration of the wall 12 may be at least partially linear and at least one of the corners may be curvilinear. In FIG. 33, for example, the shape of the wall 12 in generally rectangular, with four (e.g. at least partially linear) sides 60 and a curvilinear corner 64 formed between each pair of adjacent sides 60. In other embodiments, the shape of the wall 12 may include three, five, six, seven or more sides formed in any desired configuration.

Referring again to FIG. 1, in the preferred embodiment, the panels 14 are pre-formed, load-bearing, flat (when originally formed), releasably interconnectable, reusable and may be elastic, or able to flex into a curved shape during assembly and/or use of the holding container 10. In at least some embodiments, the originally flat panels 14 may be used to form curves in the wall 12 (e.g. by at least partially bending and/or positioning). In some embodiments, the panels 14 may be at least partially hollow (e.g. FIG. 8A) and/or at least one among the width 25 and length (or height) 24 (e.g. FIG. 9) of each panel 14 may be under 102" in a non-load-bearing state. If desired, the panels 12 may be constructed of one or more composites including at least one among plastic, plastic derivatives, wood and wood derivatives. In various embodiments, the panels 12 may be formed with a material composition rendering them resistant to microbial and biological degredaton and degredation due to the alkalinity of the earth and thus may be used to form a durable, effective and reliable partially or fully underground holding container 10 (e.g. when the wall 12 is buried at least partially below the earth's surface (e.g. FIG. 34)).

Referring again to FIG. 1, in various embodiments, when the panels 14 are interlocked to form the wall 12, at least one joint 130 may be formed between adjacent interlocked panels 14. If desired, adjacent panels 14 may overlap each other (e.g. where they are interconnected), providing enhanced strength and/or leak-prevention components (e.g. at the joints 130), any other purpose(s) or a combination thereof. For example, each panel 12 may include a main body 15 (e.g. FIG. 9) and at least one lip 40 extending outwardly therefrom. In such instances, the lip(s) 40 may having a thickness that is less than the thickness of the main body 15. If desired, a lip 40 of each panel 14 may be configured to overlap and be releasably secured to another panel 14 to interlock the panels 14 together. For example, each panel 14 may overlap each adjacent panel 14 across at least 5% of the smaller of its width and length. In some embodiments, the panels 14 may overlap more or less than 5%, such as up to 10%, 15%, 20% or more.

Referring still to FIG. 1, if desired, the panels 14 may be configured to be coupled together in a manner that allows each panel 14 to move side-to-side and up-and-down independently or in unison with one or more other panels 14 in response to variations in the substrate 20 below the panels 14 and/or loads applied to the panels 14 by contents of the storage area(s) 13 without damaging or disengaging the panels 14 or degrading the panels' 14 strength characteristics or the holding container's 10 ability to contain the contents of the storage area(s) 13, or for any other purpose. If desired, the modularity of various components of the holding container 10 may allow the overall size and/or shape of the holding container 10 to be varied during installation thereof (e.g. at the container installation site 48) or from installation to installation in increments of one or more panels 14 (e.g. five, six, eight, ten, etc.).

Figure 35:
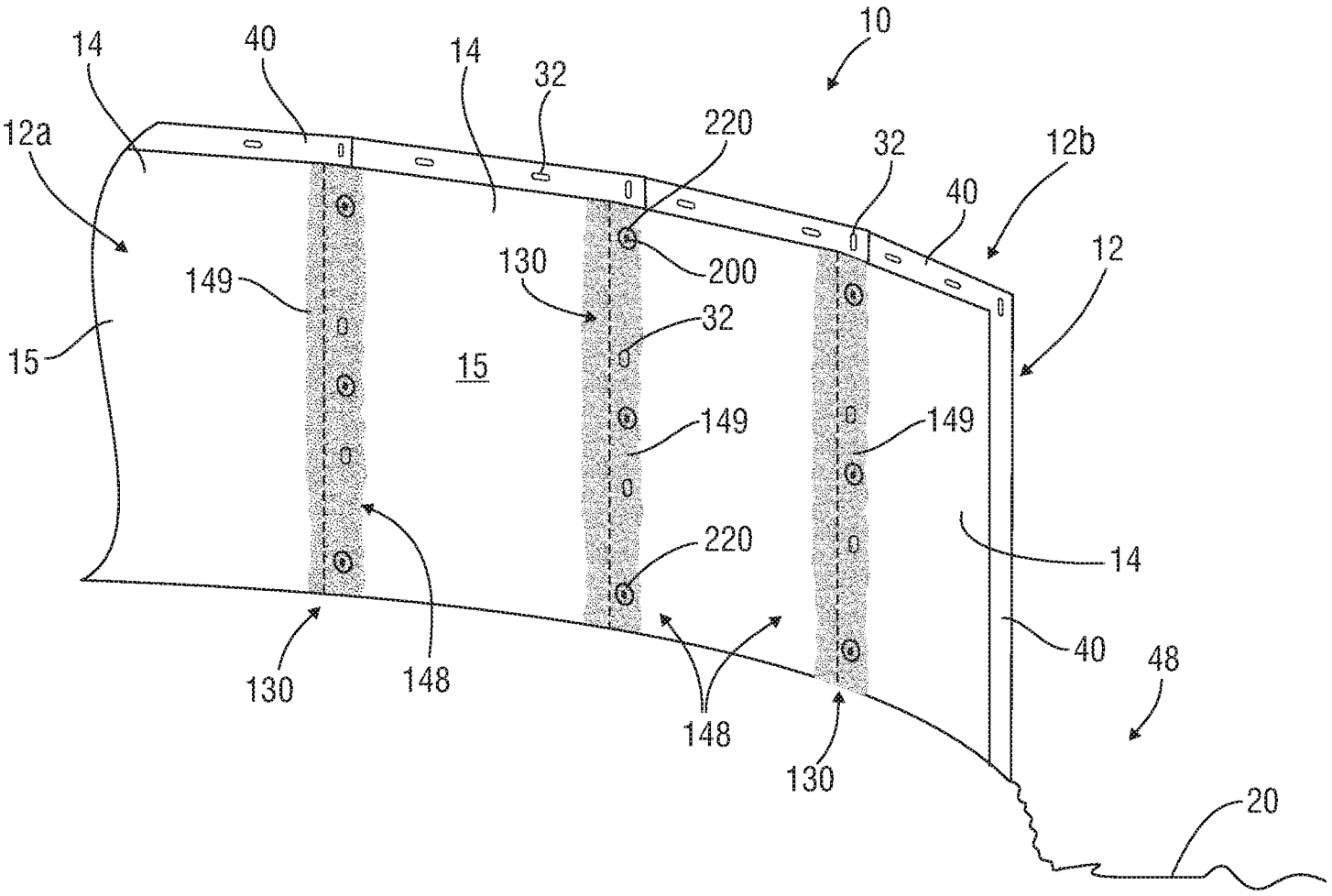
FIG. 35 is a perspective view of part of an exemplary large-capacity, modular, holding container having at least one exemplary liquid-impermeable surface provided across joints formed between adjacent exemplary panels in accordance with one or more embodiments of the present disclosure.

In many embodiments, at least one liquid-impermeable surface 148 (e.g. one or more coatings 149 (e.g. painted, sprayed or otherwise, FIGS. 35-36), liners 150 (FIGS. 21 & 36), geotextiles, spongy materials, etc.) may be disposed at least partially around the storage area 13 inside the wall 12 and configured to prevent the contents of the storage area(s) 13 from escaping out of the holding container 10. For example, a leak-free containment may be provided. In some embodiments, multiple liquid-impermeable surface(s) 148 may be used in tandem. In other instances, the liquid-impermeable surfaces 148 may extend only along certain parts of the holding container 10, such as over the joints 130 (e.g. FIG. 35) and/or on the inner side 12*a*, outer side 12*b* or other portion of the wall 12 (e.g. along one or more edges 44 of the panels 14, FIG. 7).

Still referring to the embodiment FIG. 1, the illustrated wall 12 includes an inner side 12*a* facing the storage area(s) 13, an outer side 12*b* facing away from the storage area(s) 13, an inside perimeter 18 and an outer perimeter 19, a height 21, at least one lower edge 23*a* and at least one upper edge 23*b*. If desired, a support system 22 (e.g. FIGS. 13A, 24A) may abut and/or extend around at least part of the outer side 12*b* (or outer perimeter 19) of the wall 12, such as to reinforce the wall 12, assist in supporting the load of the contents of the storage area 13 bearing upon the panels 14, maintain or support the desired upright orientation of the panels 14 during use of the holding container 10, allow the panels 14 to flex or bend (e.g. into a desired curvilinear shape), for any other desired purpose(s) or a combination thereof. However, some embodiments may not include a support system 22.

Figure 2:
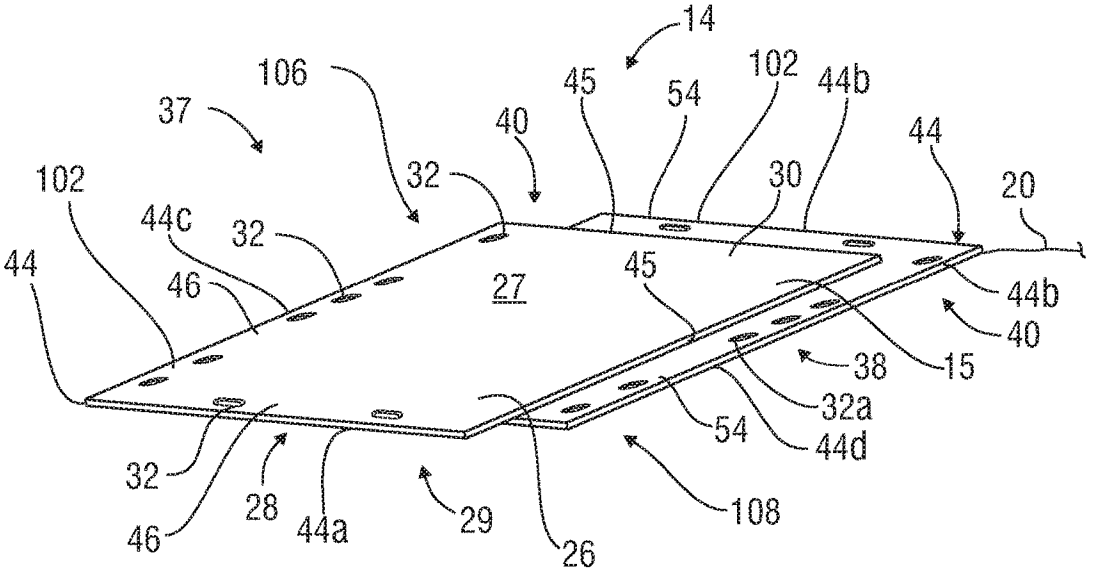
FIG. 2 is a perspective view of an exemplary ground cover useful as a large-capacity holding container panel in accordance with one or more embodiments of the present disclosure.
Figure 9:
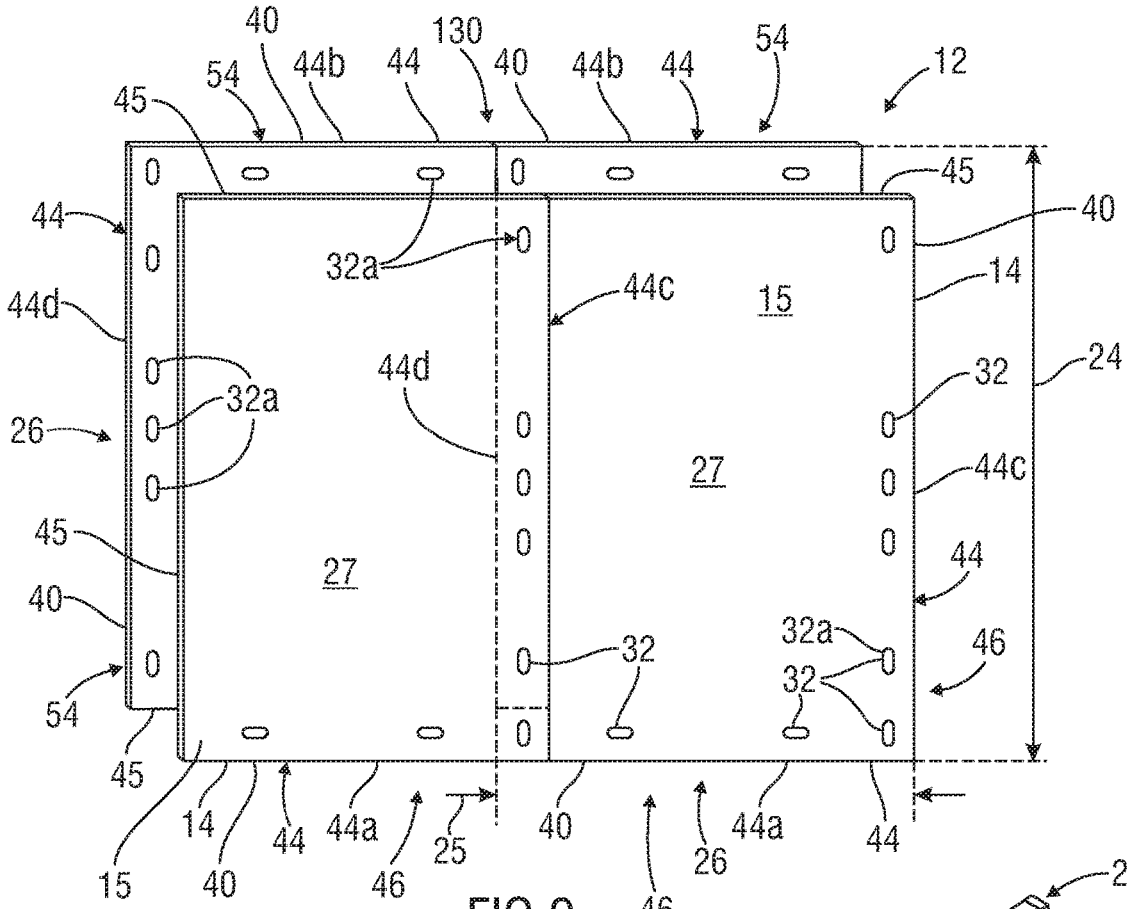
FIG. 9 is a front view of a pair of exemplary ground covers of the type shown in FIG. 2 and positioned in an upright orientation for use as exemplary large-capacity holding container panels in accordance with one or more embodiments of the present disclosure.

Referring now to FIGS. 1, 2 & 9, in the preferred embodiment, at least a first outer side edge 44*a* of each panel 14 rests at least partially upon the ground 20 and at least one opposing second outer side edge 44*b* is spaced upwardly from the ground 20. At least a third outer side edge 44*c* and at least a fourth opposing outer side edges 44*d* of each exemplary panel 14 are positioned proximate to the third outer side edge(s) 44*c* or fourth outer side edge(s) 44*d* of at least one other panel 14 to form the wall 12 and enclose the storage area(s) 13 (e.g. FIGS. 13A, 24A). In the preferred embodiment, the panels 14 are flat, or planar, (e.g. when originally formed, as mentioned above) and the outer side edges 44 are linear. However, in other embodiments, some or all of the panels 14 may be non-planar (e.g. have curvature, projections, protrusions, etc.) and/or one or more outer side edges 44 of the panels 14 may have curvature. As will be described below, in various embodiments, during use of the holding container 10, the planar panels 14 may be expected to or will bend, flex or deform within acceptable limits due to the load placed upon the panels 14, tensioning of the support system 22 (if included) use and reuse over time or other factor(s), and thus the panels 14 and/or their outer side edges 44 may develop some curvature (e.g. warping). However, in other embodiments, the panels 14 may not flex or deform. Thus, the nature and shape of the panels 14 and the outer side edges 44 thereof is not limiting upon the present disclosure and appended claims, except and only to the extent as may be expressly recited and explicitly required in a particular claim hereof and only for such claim(s) and any claim(s) depending therefrom. While the illustrated holding container 10 is shown situated on the ground 20 at the earth's surface, the holding container 10 may instead be sunken or recessed relative to the ground (e.g. in one or more trenches, channels, recesses, depressions, holes, etc.) or at least partially or fully buried (e.g. FIG. 34).

Now referring to FIGS. 2 & 9, the panels 14 may have any suitable form, configuration, construction and operation. Some examples of panels 14 are mats, sheets, ground covers, ground supports, support surfaces, and the like. The exemplary illustrated panels 14 are constructed of low-cost, high performance, composite, high-density polyethylene thermoplastic material, but could be constructed of any form or combination of materials, such as plastic, rubber, fiberglass, fiber-reinforced plastic, other natural, synthetic or composite material, recycled rubber or other recycled material, and could include steel (such as for reinforcement), wood, steel-framed wood, aluminum or other material. The illustrated panels 14 each have a front face 27, rear face 29, length (or height) 24 and width 25.

In the preferred embodiment, the panel 14 is in the form of a ground cover 26 originally designed to be used to at least partially cover an area on the ground 20 and withstand a desired or expected load thereupon. Thus, in at least some instances, the same panels 14 may be used interchangeably between forming walls 12 for large-capacity holding container 10 and as ground covers. For example, the holding container 10 may be disassembled and one or more of the panels 14 placed on the ground 20 (e.g. forming a support surface 16, FIG. 4) to serve as one or more roads, staging areas, storage areas, work sites, foundations, platforms, environmental protection surfaces, support platforms, etc. and support a desired load (e.g. multiple personnel, equipment and vehicles thereupon or moving thereacross. The support surface(s) 16 could thereafter be disassembled and the panels 14 used to from one or more other holding containers 10, and so on. In other embodiments, the panels 14 could have other alternative uses (e.g. construction material).

Figure 4:
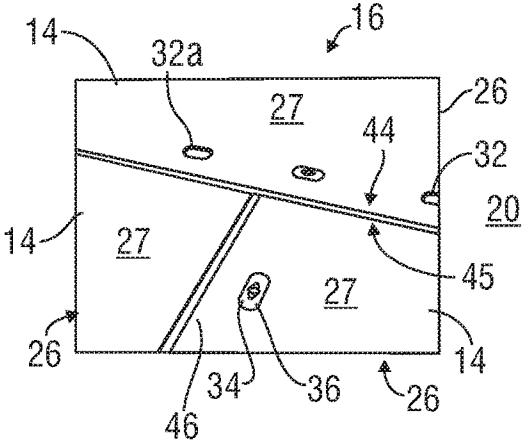
FIG. 4 is a top view of a portion of an exemplary support surface including multiple of the exemplary ground covers of FIG. 2.

Referring to FIGS. 2, 4 & 9, in some embodiments, the ground covers 26 (used as panels 14) may be capable of supporting the weight of vehicles, equipment, other structures, multiple personnel or a combination thereof thereupon and moving thereacross over a variety of types of underling terrain and conditions (e.g. standing water, swamps, sand, clay, marsh, wetlands, bog, uneven underling ground or surfaces) to provide a foundation or platform for work sites, roadways and the like, to protect the environment (e.g. the subsurface below the ground covers 26) from damage and/or contamination due to the activities performed thereupon, for other purpose(s) or a combination thereof. In some embodiments, the panels 14 (e.g. ground covers 26) may be heavy-duty, durable, all-weather and capable of supporting and withstanding substantial weight and forces placed thereupon in harsh outdoor environments, such as below freezing (e.g. −30° F. or less) to tropical/desert temperatures (115° F. or more) and harsh conditions, such as snow, ice, mud and rain. For example, the panels 14 (e.g. ground covers 26) may be configured to support heavy equipment, wheeled and/or tracked vehicles and trailers, (e.g. bulldozers, bucket-loaders, water or fuel tanker trucks, semi-trailer trucks, etc.), equipment typically used at remote oilfield or hydrocarbon production, storage, and/or transportation sites (e.g. all the types of vehicles and equipment used for hydraulic fracturing), pipeline locations, construction, military, transportation, disaster response, utilities or entertainment sites and the like. In many instances, the panels 14 (e.g. ground covers 26) can support vehicles rated as H-20, HS-20, H-25 and HS-25 by the American Association of State Highway & Transportation Officials (AASHTO). In various embodiments, the panel 14 (e.g. ground cover 26) may weight approximately 1,010 lbs. (or more or less), be designed to withstand up to, or in some cases more than, 600 psi in pure crush pressure placed thereupon, reduce point-to-point ground pressure on the subsurface 20 below it that may be caused by wheeled and/or tracked vehicles on or moving across it, or a combination thereof. A panel 14 (e.g. ground cover 26) having any of the features or capabilities mentioned in this paragraph is sometimes referred to as a "heavy-load-supporting" panel 14 (ground cover 26, or support surface 16).

Referring still to FIGS. 2, 4 & 9, in some embodiments, the panels 14 (e.g. ground covers 26) may be sufficiently buoyant to be used as a floating or partially floating foundation or platform, work site, roadway, support surface and the like for supporting equipment, vehicles and/or multiple personnel thereupon. For example, the panels 14 (e.g. ground covers 26) may be sufficiently buoyant to float over or across a waterway (e.g. creek, river) or body of water (e.g. pond, lake) or be used in other water scenarios (e.g. standing water, swamp) to serve as a floating or at least partially floating heavy-load-supporting ground cover 26 or as part of a heavy-load-supporting support surface 16. Various scenarios may require multiple stacked ground covers 26 and/or multiple side-by-side ground covers 26. For example, each ground cover 26 (e.g. perimeter-welded DURA-BASE®) may have a buoyancy reserve of approximately 800 lbs. in water having a density of approximately 62.43 lbs/cu.ft. with a ground cover displacing volume of 1800 cu.ft. and be used to create a heavy-load-supporting support surface 16. Such support surface 16, for example, having multiple (e.g. 3, 4 or more) stacked layers of multiple (e.g. 2, 3 or more) side-by-side interconnected ground covers 26 may be formed to create a bridge at least partially across a body of water or waterway to support the passage there-over of vehicles having 10,000 lbs. per axle loading. Depending upon the circumstances, the ends of the support surface 16 may need to be anchored to the earth or other stable structure, such as to prevent shifting or migration of the ground covers 26 and/or for any other purpose.

Some examples of ground covers 26 which may be used as panels 14 in various embodiments of the present disclosure, and their uses and capabilities, are shown and described in U.S. Pat. No. 5,653,551 to Seaux, entitled "System for Construction of Roadways and Support Surfaces" and issued on Aug. 5, 1997, U.S. Pat. No. 7,370,452 issued on May 13, 2008 to Rogers and entitled "Mat Assembly for Heavy Equipment Transit and Support", U.S. Pat. No. 6,511,257 to Seaux et al., entitled "Interlocking Mat System for Construction of Load Supporting Surfaces" and issued on Jan. 28, 2003, U.S. Pat. No. 7,303,800 to Rogers, entitled "Interlocking Mat" and issued on Dec. 4, 2007, all the contents of which are hereby incorporated by reference herein in their entireties. If desired, the panels 14 may be used in connection with any of the subject matter described and shown in U.S. Pat. No. 9,132,996 issued on Sep. 15, 2015 to Robertson and entitled "Crane-Mounted Grab Head", U.S. Pat. No. 9,039,325 issued on May 26, 2015 to McDowell and entitled "Liquid Containment System for Use with Load Supporting Surfaces", U.S. Pat. No. 9,745,124 issued on Aug. 29, 2017 to McDowell and entitled "Liquid Containment System", U.S. Pat. No. 9,430,943 issued on Aug. 30, 2016 and entitled "Apparatus and Methods for Providing Illuminated Signals from a Support Surface", U.S. Pat. No. 9,337,586 issued on May 10, 2016 and entitled "Apparatus & Methods for Electrically Grounding a Load-Supporting Support Surface", U.S. Pat. No. 9,368,918 issued on Jun. 14, 2016 and entitled "Apparatus and Methods for Electrically Grounding a Load-Supporting Support Surface", U.S. Pat. No. 9,735,510 issued on Aug. 15, 2017 and entitled "Apparatus and Methods for Electrically Grounding at Least one Mat in a Load-Supporting Surface", U.S. Pat. No. 9,985,390 issued on May 29, 2018 and entitled "Apparatus for Electrically Grounding at Least one Mat", U.S. Pat. No. 9,972,942 issued on May 15, 2018 to Bordelon et. al and entitled "Apparatus and Methods for Insulating a Support Mat Having an Electrically-Conductive Cover", U.S. Pat. No. 9,297,124 issued on Mar. 29, 2016 to Robertson and entitled "Methods of Moving at Least One Mat With a Crane-Mounted Grab Head", U.S. Pat. No. 10,024,075 issued on Jul. 17, 2018 to McDowell et al. and entitled "Apparatus & Methods for Supporting One or More Upright Items from a Support Surface" and U.S. patent application Ser. No. 16/141,650 filed on Sep. 25, 2018 and entitled "System, Apparatus & Methods for Manipulating a Ground Cover Attachment Pin", and U.S. patent application Ser. No. 15/484,857 filed on Apr. 11, 2017 and entitled "Apparatus, System and Methods for Providing Accessories on a Support Surface", as well as all related patents issuing from each of the applications mentioned above, all the contents of which are hereby incorporated by reference herein in their entireties.

Still referring to FIGS. 2 & 9, in the preferred embodiment, the panels 14 may be constructed of one or more materials (e.g. under 50% steel) and formed with dimensions and an internal structure and that allow the panels 14 to possess sufficient strength (e.g. used in conjunction with other components of the holding container 10 to support the load of the contents of the storage area(s) 13 acting on the wall 12 formed by the panels 14 and/or sufficient flexibility to allow the panels 14 to expand, stretch, contract, flex, bend, deform, shift and/or move during installation and/or use of the holding container 10 to at least partially conform to a desired shape or an uneven substrate 20, react or adjust to load from the contents (e.g. liquid) of the storage area(s) 13 or a combination thereof without undesirable deformation, cracking, breaking or disconnection or otherwise failing. Any of these capabilities may enhance the durability, flexibility and adaptability of the holding container 10 to the installation site location, performance (e.g. strength and longevity) and effectiveness of the holding container 10 or a combination thereof.

The panel 14 of various embodiments is a unitary (e.g. a single component), impermeable, perimeter-welded, composite, high-density polyethylene thermoplastic DURA-BASE® ground cover 26 sold by the Assignee of this patent application and possessing the characteristics described in this patent and the other patents referenced above. However, the panels 14 may have one or more of the features and capabilities described in this patent and the other patents referenced above without being DURA-BASE® ground covers. Moreover, the holding container 10 and methods of the present disclosure as will be shown, described and claimed herein may utilize panels 14 that are not ground covers 26, or which do not having the all or any of the capabilities, specifications or features, or as provided herein or in the above-referenced patents. For example, the panel 14 (e.g. ground cover 26) may not be heavy-duty, durable, all-weather, capable of supporting the weight of personnel, vehicles, equipment and/or other structures thereupon, constructed of composite, high-density polyethylene thermoplastic material, or a combination thereof, and may be designed to be used in indoor locations. Thus, the type of panel 14 is not limiting upon the present disclosure and appended claims, except and only to the extent as may be expressly recited and explicitly required in a particular claim hereof and only for such claim(s) and any claim(s) depending therefrom.

Still referring to FIGS. 2 & 7-9, in the preferred embodiment, the exemplary panel 14 (e.g. DURA-BASE® ground cover 26) has an overall length (or height) of approximately 14' and a width of approximately 8', with a main body 15 having a thickness of approximately 4" and peripheral lips 40 each extending outwardly therefrom approximately 12" and having a thickness of about 2". It is noteworthy that when two of the preferable panels 14 are interconnected to form the wall 12, the effective width of each panel 14 is approximately 7' and the effective surface area of the main body 15 of the panel 14 spans up to about 13'.

Figure 7:
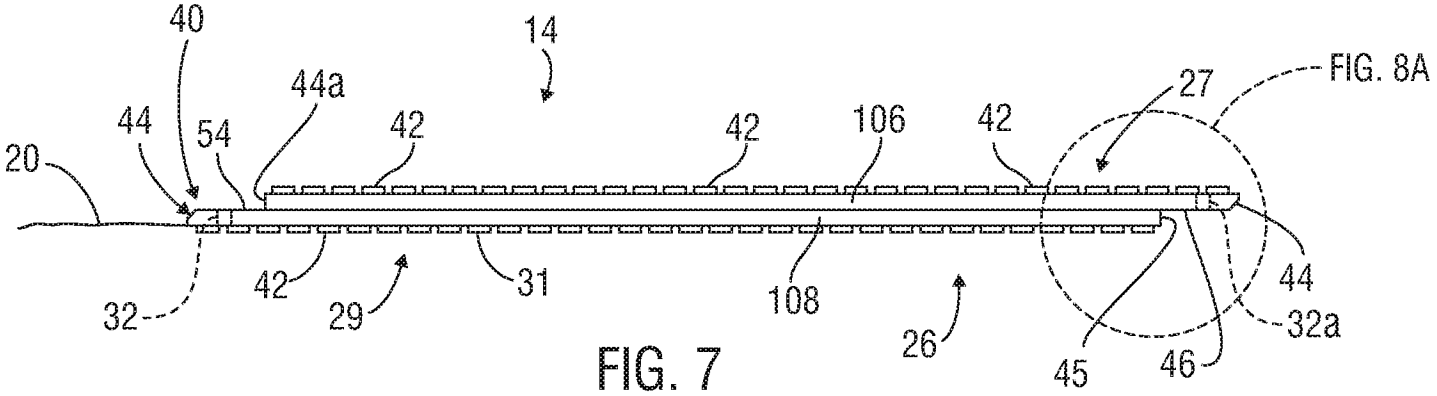
FIG. 7 is a side view of an exemplary ground cover useful as a large-capacity holding container panel in accordance with one or more embodiments of the present disclosure.
Figure 8B:
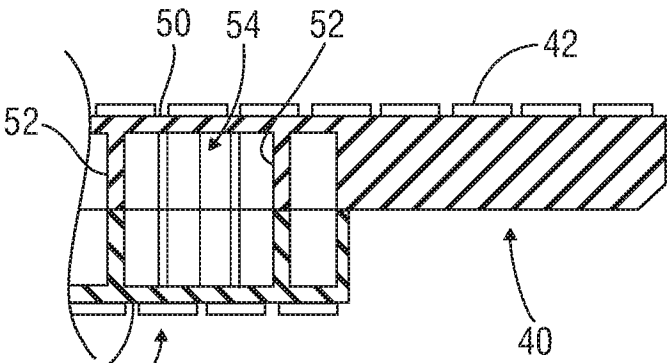
FIG. 8B is an exploded view of part of another embodiment of a ground cover useful as a large-capacity holding container panel in accordance with one or more embodiments of the present disclosure.
Figure 8A:
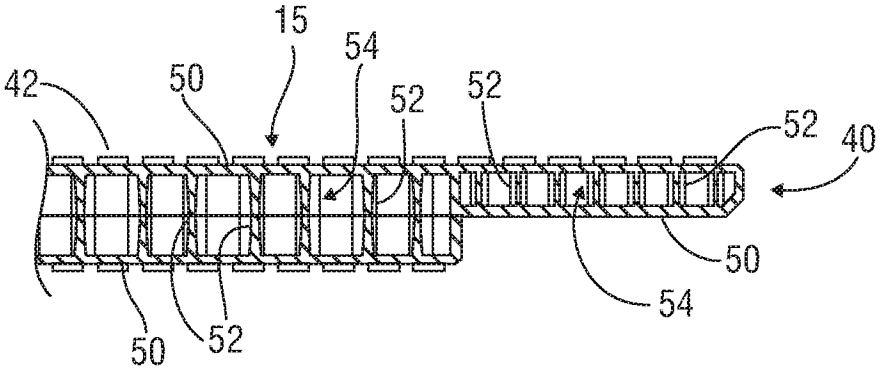
FIG. 8A is an exploded view of part of the exemplary ground cover of FIG. 7.

Referring now to FIGS. 7-8B, if desired, the panels 14 may be solid or at least partially hollow. For example, the internal structure of the panel 14 may include voids, cells, interstices or the like. In the preferred embodiment, the main body 15 and lips 40 of the (e.g. DURA-BASE®) panels 14 are formed of upper and lower outer skins 50 (e.g. FIG. 8A) and internal walls 52 extending therebetween in a desired (e.g. honeycomb) structure 54. For example, the respective outer skins 50 may have a thickness of approximately 0.40" and the internal walls 52 may have a thickness of approximately 0.40". However, the panels 14 may have any or all of the above features and dimensions, but not be DURA-BASE® ground covers. Further, the panels 14 (e.g. ground cover 26) may have different dimensions, the main body 15 and/or peripheral lips 40 may be formed with any other desired internal structure or be solid (see e.g. the solid peripheral lips 40 shown in FIG. 8B). Thus, the dimensions, internal structure and construction of the panels 14 are not limiting upon the present disclosure and appended claims, except and only to the extent as may be expressly recited and explicitly required in a particular claim hereof and only for such claim(s) and any claim(s) depending therefrom.

Referring again to FIG. 2, each illustrated panel 14 (e.g. ground cover 26) of the preferred embodiment has four sides 28, 30, 37 and 38 and a respective outer side edge 44 extending along each side. For example, the panel 14 may be rectangular and have an opposing pair of short sides 28, 30 with respective associated outer side edges 44*a*, 44*b*, and an opposing pair of long sides 37, 38 with respective associated outer side edges 44*c*, 44*d*. In other embodiments, the panel 14 may have any other desired shape (e.g. square, triangular, octagonal, etc.) with more or less than four sides (e.g. two, three, five, six, seven, etc.) and/or multiple outer side edges 44 (e.g. two, three, four, etc.) on each side. The exemplary panel 14*s* (e.g. ground cover 26) are also reversible. In other words, the top (e.g. face 27) and bottom (e.g. face 29) of the illustrated panel 14 are mirror images of one another. However, in other embodiments, the panels 14 may not be reversible.

Referring back to FIG. 1, in the preferred embodiment, since the outer side edge 44*a* of the short side 28 of each panel 14 rests at least partially upon the ground 20, the panels 14 are stood upright lengthwise. In other embodiments, the outer side edge 44*b* of the other short side 30 of each panel 14 could rest at least partially on the ground 20 to similarly stand the panels 14 upright lengthwise. In yet other embodiments, either side edge 44*c*, 44*d* of the respective long sides 37, 38 of the panels 14 could rest at least partially upon the ground 20 to stand the panels 14 upright widthwise. In still other embodiments, any combination of such configurations of panel orientation may be used in forming a holding container 10 (e.g. a holding container 10 with a combination of short and long-side outer side edges 44*a-d* resting on the ground 20).

Referring back to FIG. 2, in this embodiment, each flat panel 14 (e.g. ground cover 26) has a "stepped-configuration" and is constructed of two partially overlapping, interconnected, sheets 102 (upper and lower sheets 106, 108) that form the peripheral lips 40. For example, the illustrated sheets 106, 108 form an "upper" lip 46 along each of the first short side 28 and first long side 37 and a "lower" lip 54 along each of the second short side 30 and second long side 38. In addition to the outer side edges 44*a-d*, a respective inner side edge 45 is also formed along each side 28, 30, 37, 38 of the exemplary panel 14. In other embodiments, the panel 14 may not include multiple sheets, have a stepped-configuration or a combination thereof.

In this embodiment, the exemplary sheets 106, 108 are each rectangular, have substantially identical dimensions and are geometrically-aligned so that the respective outer and inner side edges 44, 45 formed along each side 28, 30, 37, 38 are at least substantially parallel to each other. In other embodiments, any quantity of sheets 102 (e.g. 3, 4, 5 or more) may be used to form the panel 14 (e.g. ground cover 26) and/or the sheets 102 may have differing shapes (e.g. a first sheet 102 being rectangular and a second sheet 102 being square), sizes and/or dimensions (e.g. the second sheet being smaller than the first sheet). The exemplary sheets 106, 108 may be perfectly overlapping relative to one another (e.g. FIGS. 3A-C) or not geometrically-aligned, may form only one, two, three or more than four peripheral lips 40 or other non-overlapping portions, or a combination thereof. If desired, the panel 14 may be formed of two or more sheets 102 having the same shape (e.g. rectangular, square, hexagonal) but different sizes. Thus, the sheets 102, when included, may have any desired shape and configuration, and the multiple sheets 102 used to form a single panel 14 may differ in shape, size, dimensions, configuration and any other characteristics.

In some embodiments, the panel 14 may be formed of one sheet or other component, or a combination of more than two components (e.g. sheets 102) and/or may have any desired overall shape (square, triangular, hexagonal, other geometric arrangement, etc.). Further, in various embodiments, different shaped panels 14 may be used to form the same holding container 10. In various embodiments, the wall 12 of the holding container 10 may be formed partially with panels 14 and partially with one or more other components (e.g. natural barrier, pre-existing structure, concrete wall, steel door, etc.). Further, the holding container 10 and methods of the present disclosure as will be shown, described and claimed herein are not limited to use with stepped-configuration panels 14, ground panels 14 having upper and lower lips 46, 54 or other features as described above, and may be constructed with panels 14 not having a stepped-configuration and/or upper and lower lips 46, 54, as well as panels having less or more than four lips (e.g. 1, 2, 3, 5, 6, etc.), except as otherwise as may be expressly recited and explicitly required in a particular claim hereof and only for such claim(s) and any claim(s) depending therefrom.

Still referring to FIG. 2, in this embodiment, the sheets 102 forming the panel 14 (e.g. ground cover 26) are interconnected by a process known as hot-plate welding to form a unitary panel 14 with a congruous structure. In other embodiments, the sheets 102 (or other components of the panel 14) may be interconnected by other forms of welding, molding, bolts or other mechanical connectors or other methods, etc. Thus, present disclosure is not limited by the material construction and method of interconnecting the sheets 102, except and only to the extent as may be explicitly required in a particular claim hereof or in a patent application or patent claiming priority hereto and only for such claim(s) and any claim(s) depending therefrom.

Referring back to FIGS. 1, 2 & 9, each exemplary panel 14 includes one or more receptacles 32 that can be used for connecting the panel 14 with one or more adjacent panels 14 (and/or other component(s)) and configured to sustain forces and load applied thereto to hold the panels 14 together during normal or expected use of the holding container 10. The receptacles 32 may have any desired form, configuration, construction and location and may be used for interconnecting adjacent panels 14 in any desired manner. For example, the illustrated receptacle 32 is a connection hole 32*a* extending through the panel 14 (e.g. FIG. 5). In other embodiments, the receptacle 32 may include one or more cut-outs, cavities, notches, orifices or passageways formed in the panel 14, or one or more rings, clips, brackets or any other desired mechanisms coupled to or extending from the panel 14 and useful to connect it with one or more other panels 14 (or other components).

Figure 6:
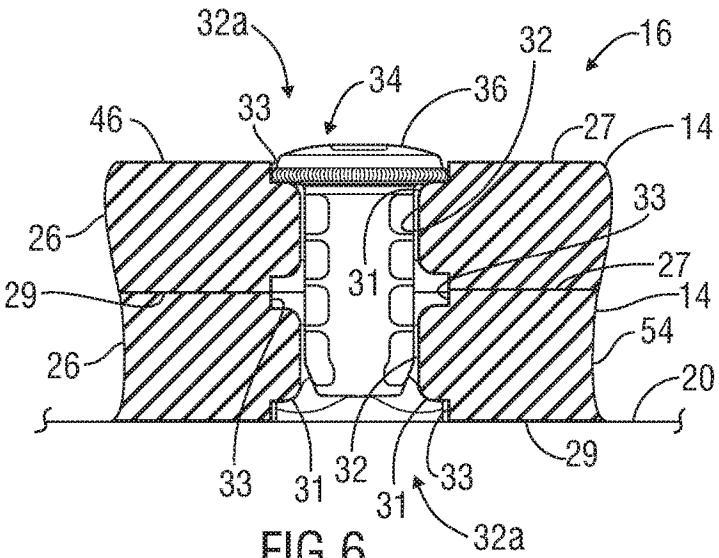
FIG. 6 is a partial cross-sectional view of an exemplary attachment pin shown engaged with two of the exemplary ground covers shown in FIG. 4.

The illustrated panels 14 (e.g. ground covers 26), for example, include a plurality of receptacles 32 (e.g. connection holes 32*a*) spaced apart at different positions along the height 24 and width 25 of the panel 14, at least some of which can be used to interconnect each panel 14 with at least one other panel 14. For example, at least some of the exemplary receptacles 32 of each panel 14 can be aligned over or under a receptacle 32 of an adjacent panel 14 to connect them together, such as with the use of vertical joining members, such as panel connectors 200 (e.g. FIG. 12). In the context of the illustrated ground covers 26 being used as panels 14, the exemplary connection holes 32*a* are originally designed to seat removable ground cover attachment pins 34 for connecting the ground covers 26 together, such as shown in FIGS. 4 & 6. In FIG. 4, three ground covers 26 are shown interconnected to form a support surface 16 in the context of their intended use.

Referring to FIGS. 2 & 9, in the illustrated embodiment, the receptacles 32 are formed in the overlapping upper and lower lips 46, 54 of the panels 14 to interconnect them together. Each exemplary panel 14 (e.g. ground cover 26) includes, for example, a total of sixteen receptacles 32, eight receptacles 32 formed in each set of upper and lower lips 46, 54. However, any other desired number of receptacles 32 (e.g. 1, 2-16 or more than 16) may be provided at any desired location in each panel 14. Likewise, different panels 14 may have a different quantities and types of receptacle 32.

Figure 5:
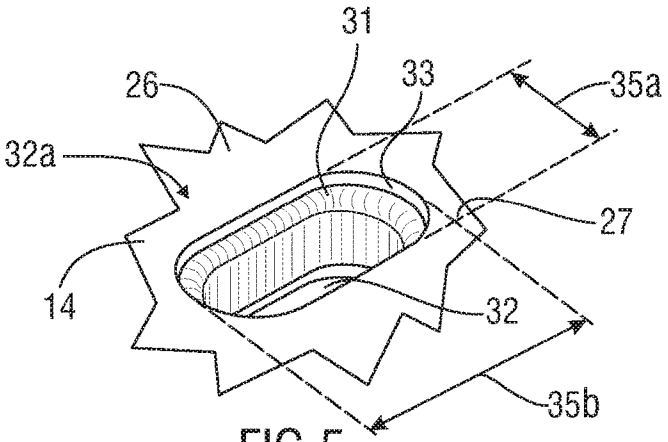
FIG. 5 is a perspective view of an exemplary attachment pin hole of the ground cover of FIG. 2.

Referring now to FIGS. 5 & 6, the exemplary receptacles 32 have a non-circular, or asymmetrical, cross-sectional shape. In this embodiment, receptacles 32 (e.g. connection holes 32*a*) have an oblong cross-sectional shape, are originally designed to accept an oblong-shaped ground cover attachment pin 34 to prevent the pin 34 from rotating therein, have a width, or minimum internal diameter, 35*a* and a length, or maximum internal diameter, 35*b*. Further, an oblong-shaped recess, or indentation, 33 is formed in each face 27, 29 of each exemplary panel 14 (e.g. ground cover 26) around each connection holes 32*a* and originally designed to at last partially seat an enlarged, oblong-shaped head 36 of the exemplary ground cover attachment pin 34. Each illustrated indentation 33 includes a rim 31 that has a curved outer surface and thus a circular arc, or radius. In connection with the original use of the exemplary ground covers 26, as shown in FIG. 6, the illustrated attachment pin head 36 at least partially seats within the indentation 33 and abuts the rim 31 of the uppermost panel 14. In this example, the ground cover attachment pin 34 fits snug in the connection hole 32*a*. However, the receptacles 32 may have a different cross-sectional shape (e.g. circular, rectangular, hexagonal, square, octagonal, C-shaped, U-shaped, etc.) structure, location, configuration and form suitable for use in constructing a holding container 10 in accordance with the present disclosure. The present disclosure is thus not limited by the nature of the receptacles 32, except and only to the extent as may be expressly recited in a particular claim and only for that claim and its dependent claims.

Figure 3C:
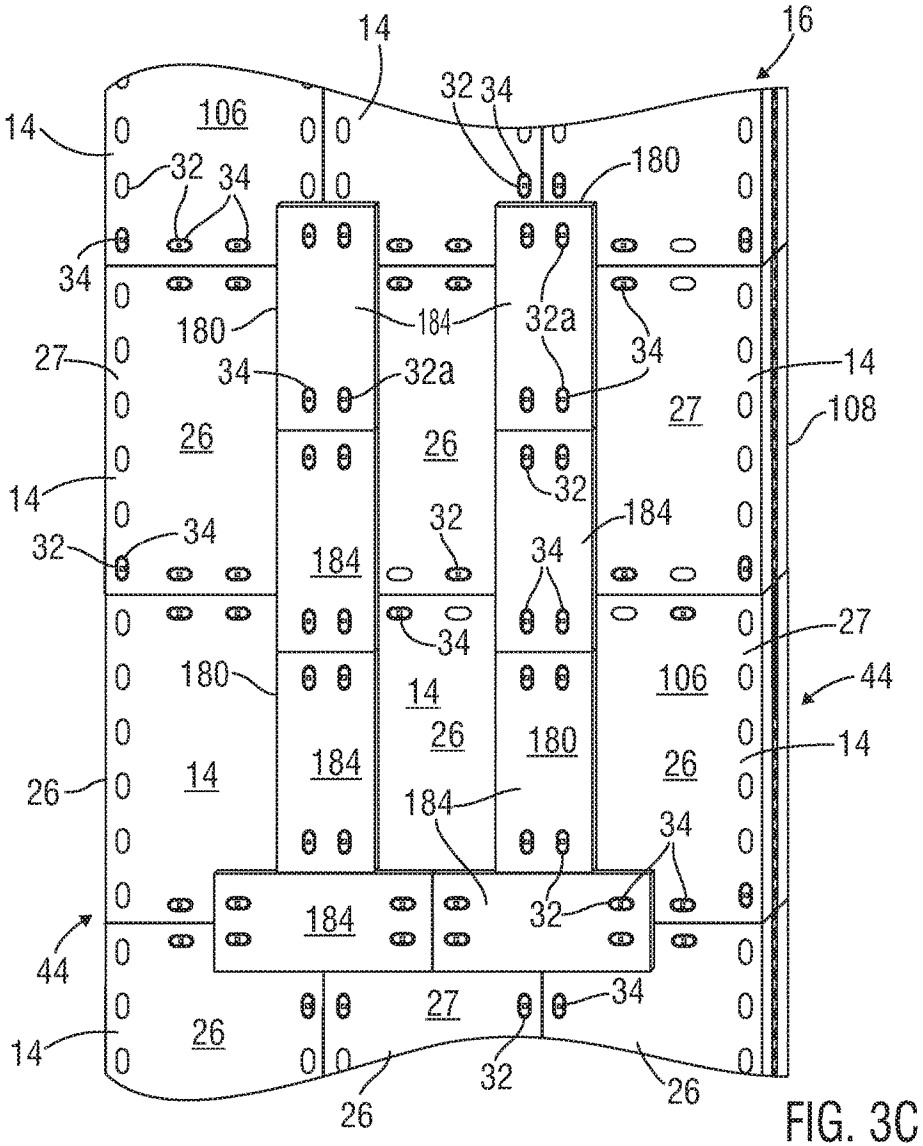
FIG. 3C is an exemplary support surface that includes numerous of the exemplary ground covers of FIG. 3A and exemplary mating plates of FIG. 3B in accordance with one or more embodiments of the present disclosure.
Figure 3A:
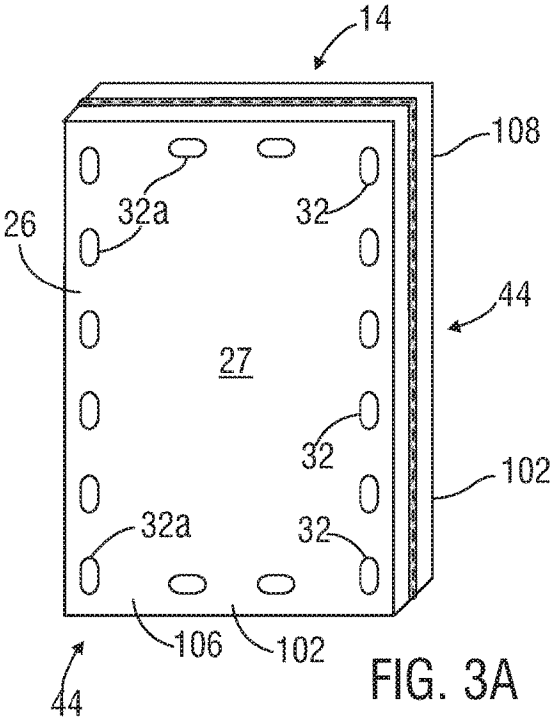
FIG. 3A is a perspective view of another embodiment of an exemplary ground cover useful as a large-capacity holding container panel in accordance with one or more embodiments of the present disclosure.
Figure 3B:
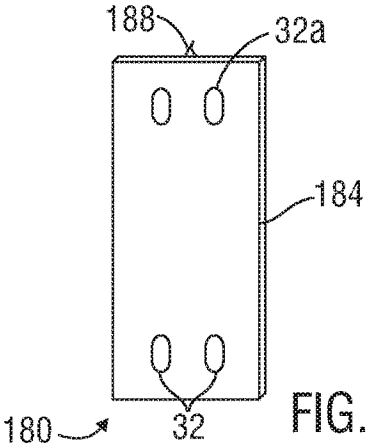
FIG. 3B is a perspective view of an exemplary mating plate useful for interconnecting multiple large-capacity holding container panels such as the exemplary ground cover shown in FIG. 3A in accordance with one or more embodiments of the present disclosure.

Referring now to FIGS. 3A-3C, in some embodiments, receptacles 32 may also or instead be formed in or associated with additional components to facilitate or support interconnection of the panels 14. In the illustrated example, panel connection pads 180 are useful to facilitate/support interconnect of adjacent panels 14. For example, the panel connection pads 180 may be particularly useful with panels 14 lacking protruding lips 40 or other portions, such as non-stepped-configuration ground covers 26.

When included, the panel connection pads 180 may have any suitable form, configuration and operation. In this embodiment, the panel connection pads 180 are mating plates 184. The mating plates 184 may be constructed of the same material as the panels 14 (e.g. composite, high-density polyethylene, thermoplastic material, rubber, plastic, fiberglass, fiber-reinforced plastic, recycled rubber, steel, wood, etc.) or any other suitable material. In this example, the mating plates 184 are steel, have dimensions (e.g. length, width, thickness) smaller than the panels 14 and include receptacles 32 in the form of connection holes 32*a* (e.g. as described above).

As shown in FIG. 3C, in this particular embodiment, the exemplary mating plates 184 are configured to be placed atop adjacent panels 14 and releasably interconnected therewith with panel connectors 200. In this example, the mating plates 184 may be positioned horizontally or vertically. If desired, the panel connection pads 180 may include protruding alignment tabs, or fins, 188, such as to extend between adjacent panels 14 and assist in aligning the panel connection pads 180 relative to the panels 14 (e.g. FIG. 3B).

As shown in FIGS. 7 & 8B, in some embodiments, the upper and/or lower surfaces 27, 29 of the panel 14 (e.g. ground cover 26) may include raised traction promoting elements, such as the treads 42, formed in or extending from the panel 14. While the treads 42 are often included in ground covers 26 for the purpose of assisting in promoting good traction with vehicles and/or equipment moving over the ground cover 26, the treads 42 may be useful in some embodiments of the exemplary holding container 10 to promote, encourage or enhance the desired abutting contact (e.g. enable gripping contact) between the panels 14 of the wall 12 and one or more other components of the holding container 10 (e.g. the support system 22, liquid-impermeable surfaces 148, etc.) and/or for any other desired purpose(s).

When included, the treads 42 may have any desired form, configuration, arrangement and operation. For example, in the preferred embodiment, at least some of the treads 42 are formed in the front and rear faces 27, 29 of the panel 14 over the internal walls 52 of the honeycomb structure 54 of the panel 14. In some stepped-configuration embodiments, the treads 42 may not be included on the underside of each peripheral lip 40 (the portion of each exemplary sheet 106, 108 of the panel 14 that extends beyond the other respective sheet 106, 108). In other words, in the illustrated panel 14, the upper surface 27 of the panel 14 that forms the lower lip 54 (which is the portion of sheet 108 that extends beyond sheet 106) is absent the treads 42. Thus, the receptacles 32 on the exemplary upper lips 46 are surrounded by treads 42, while the receptacles 32 on the illustrated lower lips 54 are not surrounded by treads 42. Of course, when the same panel 14 is turned over, the former lower lip 54 (absent treads 42) becomes an upper lip 46 having treads 42. Some exemplary raised traction promoting elements that may be used on the panels 14 (e.g. ground covers 26) in some embodiments are shown and described in U.S. Pat. No. 6,511,257. However, the treads 42 may have any other form, configuration, pattern and location and may not be included.

Figure 10:
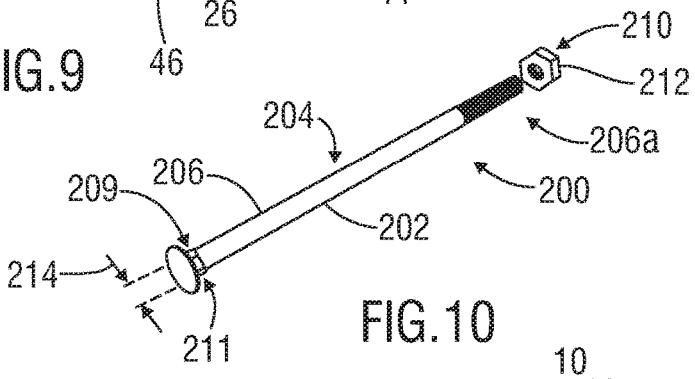
FIG. 10 is a perspective view of an exemplary vertical joining member in accordance with one or more embodiments of the present disclosure.
Figure 11:
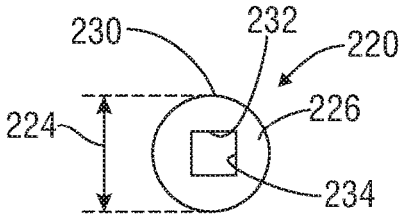
FIG. 11 is a front view of an exemplary intermediate plate in accordance with one or more embodiments of the present disclosure.
Figure 12:
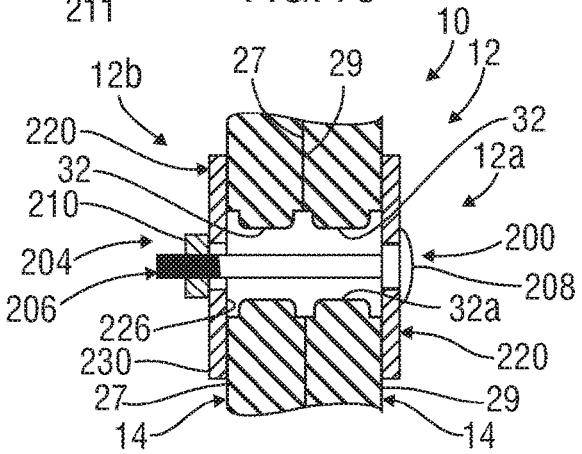
FIG. 12 is a partial cross-sectional view of the exemplary vertical joining member of FIG. 10 and exemplary intermediate plate of FIG. 11 shown being used to couple together a pair of exemplary holding container panels in accordance with one or more embodiments of the present disclosure.

Referring now to FIGS. 10-12, when included, the panel connectors 200 may have any suitable form, configuration and operation. The exemplary panel connectors 200 are selectively releasable and adjustable. In this embodiment, each panel connector 200 is engageable with at least two adjacent panels 14 proximate to at least one receptacle 32 of each panel 14 and configured to firmly couple the adjacent panels 14 together when the panels 14 are arranged upright and side-by-side. For example, a multitude of the panel connectors 200 are used in the formation of the holding container 10.

In some embodiments, the panel connector 200 is a pin 204 that extends through a pair of overlapping receptacles 32 of adjacent panels 14 and is releasably secured to the panels 14 and adjustable. In the preferred embodiment, the pin 204 is a bolt 206 securable to the adjacent panels 14 with at least one releasable lock 210, such as a nut 212 engageable with threads at the second end 206*b* of the bolt 206. For example, the bolts 206 may be carriage bolts having a diameter, or width, 214 of approximately 0.75"-1.0" and a length 216 of approximately 8". The exemplary pin 206 is adjustable by tightening or loosening the nut 112. However, the pin 206 may take any other desired form, such as a cotter pin, expandable pin, clip, clamp, etc. Likewise, the lock 110 may take any other desired form, such as a clip, pin, etc. In some embodiments, a lock 110 may not be included or the pin 204 may be self-locking or include a locking mechanism. In various embodiments, the panel connectors 200 may not be adjustable. Moreover, the panel connectors 200 may have any other suitable form, configuration and operation. For example, the panel connectors 200 may be integral or rigidly coupled to the panels 14 or other component(s).

Referring still to FIGS. 10-12, if desired, the exemplary panel connector 200 may be configured to allow relative up-and-down and/or side-to-side movement of the panels 14 relative to the panel connector 200 engaged therewith. This may be useful to allow the illustrated panels 14 to shift, float or move up-and-down and side-to-side during installation and/or use of the holding container 10 without disengaging from the panel connectors 200 or causing damage to the panel connector 200, adjacent panels 14 or other components of the holding container 10. The up-and-down and/or side-to-side movement of one or more panels 14 in the holding container 10 is sometimes referred to herein as the "floating" of the panel 14. In various embodiments, the floating of the panels 14 may be useful, for example, to allow the panels 14 to expand, stretch, contract, flex, bend, shift and/or move during installation and/or use of the holding container 10 so the panels 14 can at least partially conform to the shape of one or more components of the support system 22, adjust position on uneven substrate 20, react or adjust to load placed upon them by the contents (e.g. liquid) in the storage area(s) 13, for any other desired purpose(s) or a combination thereof.

Still referring to FIGS. 10-12, if desired, the panel connectors 200 may be configured to allow the panels 14 engaged therewith to float as desired in any suitable manner and with any suitable components. For example, referring to FIG. 12, when the panel connectors 200 extend through the receptacles 32 (e.g. connection holes 32*a*) of adjacent panels 14, the body portion 202 of the panel connector 200 disposed within the receptacles 32 may have a width, or outer diameter, 214 that is smaller than the minimum width 35*a* (e.g. FIG. 5) of each associated receptacle 32. In the preferred embodiment, each panel connector 200 is a pin 204 with a body portion 202 having an outer diameter 214 that is smaller than the length 35*b* and width 35*a* of the connection holes 32*a* of the associated interconnect panels 14, allowing the panels 14 to float. For example, when a connecting hole 32*a* has a width 35*a* of approximately 1.50" or more and a length 35*b* of approximately 3.75" or more, a panel connector 200 having a body portion 202 with an outer diameter 214 of approximately 0.75"-1.0" may allow the corresponding panels 14 to float sideways up to approximately 0.50" and up-and-down up to approximately 2.75" (and angularly) relative to the panel connector 200. However, any other dimensions may be used. In the preferred embodiment, this ability of all the panels 14 of the exemplary wall 12 to float relative to its connectors 200 may, cumulatively, be substantial and provide significant flexibility, installation site/geographic adaptability, enhanced performance (e.g. strength and longevity) and/or effectiveness of the holding container 10 or a combination thereof. For example, if the exemplary holding container 10 includes fifty panels 14 (e.g. ground covers 26) formed in circle having an approximate 250' circumference, the cumulative floating (expansion, stretching, contraction, flexing, bending, shifting and/or moving) of the totality of the panels 14 in the wall 12 may be up to 3' without weakening the panels 14, disengaging the panels 14 from the panel connectors 200 or damaging any components of the holding container 10. In some instances, the floating of the panels 14 may be further enhanced when the panels 14 are constructed with a material composition and internal structure (such as described above) that allow them to bend and flex within acceptable limits. However, in other embodiments, the panels 14 may float in a different manner or not float.

Still referring to the embodiment of FIGS. 10-12, if desired, at least one intermediate plate 220 may be configured to be sandwiched between each respective panel connector 200 and the front face 27 of the associated panel 14 that forms the outer side 12*b* of the wall 12 and/or the rear face 29 of the associated panel 14 that forms the inner side 12*a* of the wall 12. Each exemplary plate 220 may surround the panel connector 200 relative to the panels 14 and have a smallest width, or outer diameter, 224 that is greater than the length 35*b* and width 35*a* of the associated connection hole 32*a* in the panels 14. The plates 220 may be included, for example, to provide sliding surfaces 226 along which the illustrated panels 14 move up-and-down and/or side-to-side relative to the associated panel connector 200 without the panels 14 and panel connectors 200 becoming disengaged or damaged. However, any other configuration of parts may be used to allow the relative movement between each panel connector 200 and its associated panels 14, if this feature is included.

The intermediate plates 220, when included, may have any suitable form, configuration, construction and operation. For example, the sliding surface(s) 226 of each plate 220 may be sized and configured to abut the respective associated panel 14 in a manner that spreads or dissipates pressure, load, stresses, forces or a combination thereof placed upon the panel connector 200 during installation and/or use of the holding container 10. In embodiments in which significant load is expected or placed upon the panel connectors 200 during use of the holding container 10, the size and strength of the panel connectors 200 and the use, size and strength of the intermediate plates 220 may be important in maintaining the integrity of the holding container 10.

Still referring to FIGS. 10-12, in the preferred embodiment, some of the intermediate plates 220 are washers 230. The illustrated washers 230 are round, have an outer diameter of approximately 6" and a thickness of approximately 1.25". For example, when the panel connector is a pin 204 having a head 208 at a first end thereof, a first washer 230 (or other form of intermediate plate 220) may be sandwiched between the head 208 of the pin 204 and the inner side 12*a* of the wall 12 and a second washer 230 (or other form of intermediate plate 220) may be sandwiched between the releasable lock 210 (or second end of the pin 204) and the outer side 12*b* of the wall 12. However, any other dimensions, forms and locations of intermediate plates 220 may be used.

Still referring to FIGS. 10-12, if desired, the washers 230 (or other form of intermediate plate 220) may be configured to rigidly engage the panel connector 200 and/or allow the panel connector 200 to self-tighten, such to ensure the panel connector 200 and intermediate plate 220 stay together when the corresponding panels 14 move up-and-down and side-to-side, for any other desired purpose(s) or a combination thereof. For example, the washer 230 (or other form of intermediate plate 220) may have a mating portion 232 for releasably mating with the panel connector 200. In this embodiment, the mating portion 232 is a square orifice 234 through which the body of the 202 panel connector 200 extends and into which a mating portion 209 (e.g. square base 211) of the panel connector 200 seats. The exemplary mating portion 206 of the panel connector 200 is thus seatable in the mating portion 232 of the washer 230 and prevents relative rotation between the pin 204 and washer 230. However, the washers 230 and other forms of intermediate plates 220 may rigidly engage the panel connector 200 and/or allow the panel connector 200 to self-tighten in any other suitable manner or not at all.

Figure 25:
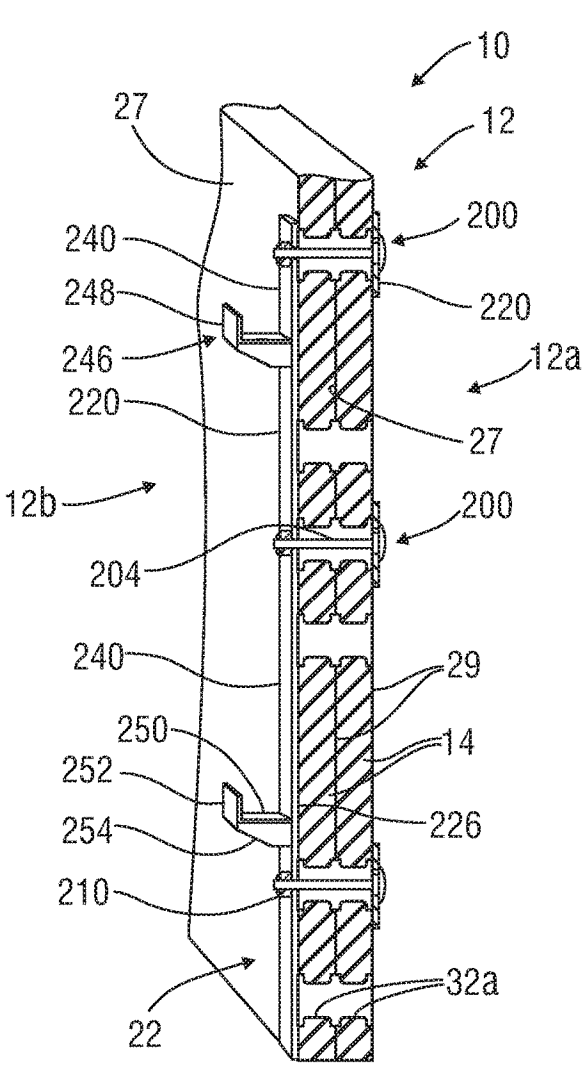
FIG. 25 is a cross-sectional view of part of the exemplary large-capacity holding container of FIG. 24A before attachment of the exemplary horizontally-extending connector.

Referring briefly to FIG. 25, another form of intermediate plate 220 useful is some embodiments of the holding container 10, which may possess any or all of the features of the plates 220 described above (e.g. includes sliding surfaces 226, allows floating of the panels 14, etc.), is an attachment bracket 240. In the preferred embodiment, the attachment brackets 240 are particularly configured to be held by at least one panel connector 200 against or proximate to the outer side 12*a* of the wall 12, surround the panel connector 200 and at least partially support one or more exemplary horizontally-extending connectors, or braces, 260, as will be described further below. However, the attachment brackets 240 may have any other disposition and purpose(s), may be integral or rigidly coupled to the panel(s) 14 or other components or may not be included.

Referring back to FIG. 1, when included, any desired number of panel connectors 200 may be used in the assembly of the holding container 10, such as based upon the expected load placed upon the panels 14 during use of the holding container 10, the location and type of attachment brackets 240 used to support the horizontal braces 260, any other considerations or a combination thereof. When numerous pairs of receptacles 32 of the respective adjacent panels 14 in the exemplary wall 12 align with each other, for example, at least one panel connector 200 may be employed in at least one of the aligned pairs of receptacles 32 to secure the panels 14 together. In the preferred embodiment, each pair of adjacent panels 14 includes a total of five pairs of aligned receptacles 32. Thus, one or more exemplary panel connectors 200 may be used at the intersection or junction of each pair of adjacent panels 14 at up to five locations. In many cases, only one panel connector 200 will be used at each location. In the illustrated embodiment, three panel connectors 200 are shown engaged between each pair of panels 14 during the installation process and one or two additional panel connectors 200 (and intermediate plates 220) may be added later. In some embodiments, five panel connectors 200 may not be necessary at each junction of panels 14 and a smaller quantity (e.g. 1, 2, 3 or 4) of panel connectors 200 may be used. For example, when the load placed upon the wall 12 of the exemplary holding container 10 by contents of the storage area(s) 13 is expected to generally decrease going up the wall 12, it may be possible to use fewer panel connectors 200 along the upper part of the height 21 of the wall 12.

In some embodiments, each pair of adjacent panels 14 may include a smaller larger quantity of aligned receptacles 32 and any desired number of panel connectors 200 (e.g. 1-4, 6, 7, 8 or more) may be used at any desired locations along the wall 12. In various embodiments, panel connectors 200 may be used at different locations at different panel 14 junctions along the wall 12. In still further embodiments, more than one panel connector 200 may be used at the same location (e.g. pair of aligned receptacles 32) on the wall 12.

Figure 13A:
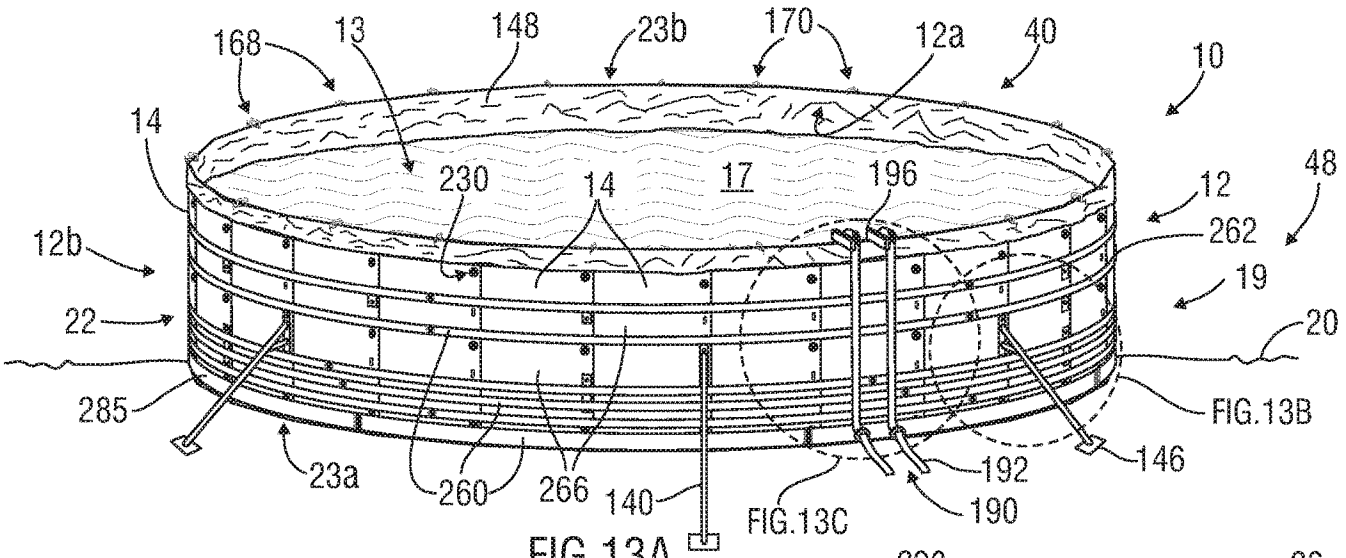
FIG. 13A is a perspective view an exemplary large-capacity, modular, holding container employing an exemplary support system that includes the hardware shown in FIGS. 14-19 in accordance with one or more embodiments of the present disclosure.
Figure 13B:
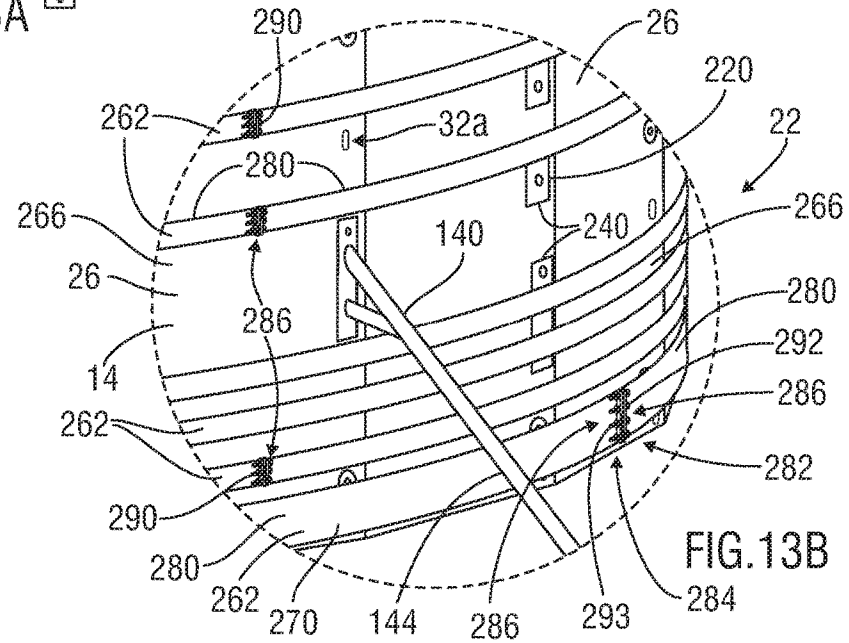
FIG. 13B is an exploded view of part of the exemplary large-capacity, modular, holding container shown in FIG. 13A.
Figure 13C:
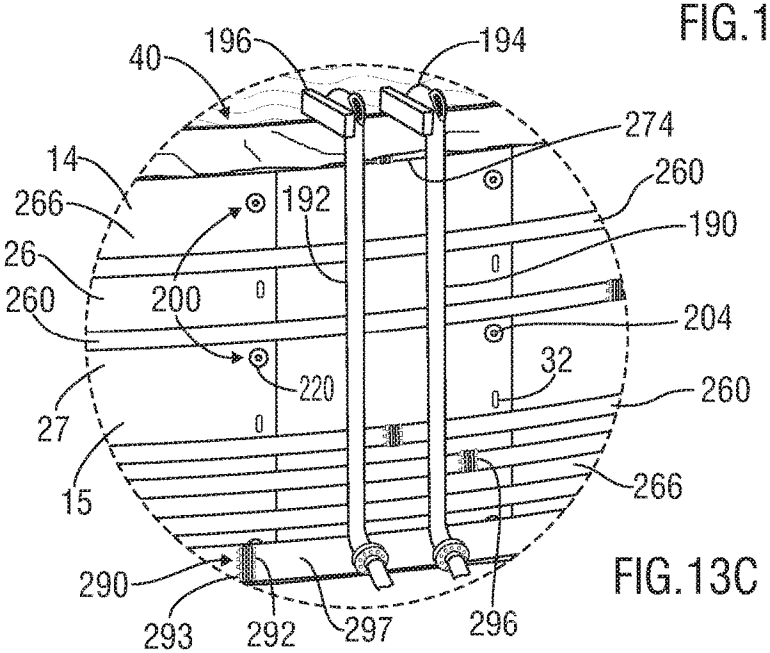
FIG. 13C is an exploded view of another part of the exemplary large-capacity, modular, holding container shown in FIG. 13A.

Referring now to FIGS. 13A-C, in the preferred embodiment, at least part of the exemplary support system 22 abuts at least part of the outer side 12*b* of the wall 12 around at least part of the outer perimeter 19 of the wall to reinforce the wall 12 and assist in supporting the load of the contents of the storage area 13 bearing upon the panels 14, maintaining the desired upright orientation of the panels 14, allowing the panels 14 to form flex), for any other desired purpose(s) or a combination thereof. For example, the support system 22 may be configured to generally support some (e.g. approximately 10-45%) or a substantial amount (e.g. approximately 45%-70% or more) of the load of the contents of the storage area 13 bearing upon the panels 14.

When included, the support system 22 may have any suitable form, configuration, components and operation. For example, the exemplary support system 22 includes at least one horizontally-extending connector, or brace, 260 configured to be coupled between and/or around two or more adjacent panels 14. The horizontal braces 260 of various embodiments may be rigid or flexible, configured to interlock adjacent panels 14 and/or assist in retaining the panels 14 in interlocking engagement, flex into abutting contact with the corresponding panels 14, support load applied to the panels 14 by contents of the storage area(s) 13 during use of the holding container 10, assist in allowing the panels 14 to form the curved portion(s) of the wall 10, for any other purpose(s) or a combination thereof.

Still referring to FIGS. 13A-C, in the preferred embodiment, the horizontally-extending connectors 260 are external to the panels 14 (e.g. not integral) and configured to extend at least partially around the outer perimeter 19 of the wall 12 and reinforce the wall 12. For example, each horizontal brace 260 may extend around the entire outer perimeter 19 of the wall 12. Since the illustrated wall 12 is formed in a generally cylindrical, or ring-like, shape (e.g. circle, oval, oblong-shape, elliptical shape, etc.), each exemplary horizontal brace 260 has, or forms, a generally cylindrical, or ring-like shape. However, the wall 12 and horizontal brace(s) 260 may each have any other overall shape (e.g. square, triangular, rectangular, etc.) and/or may have differing shapes. Further, in some embodiments, the horizontally-extending connectors 260 may be integral with or rigidly coupled to the panels 14 or other components. For example, various embodiments may include some integral and some external horizontal braces 260.

Figure 27:
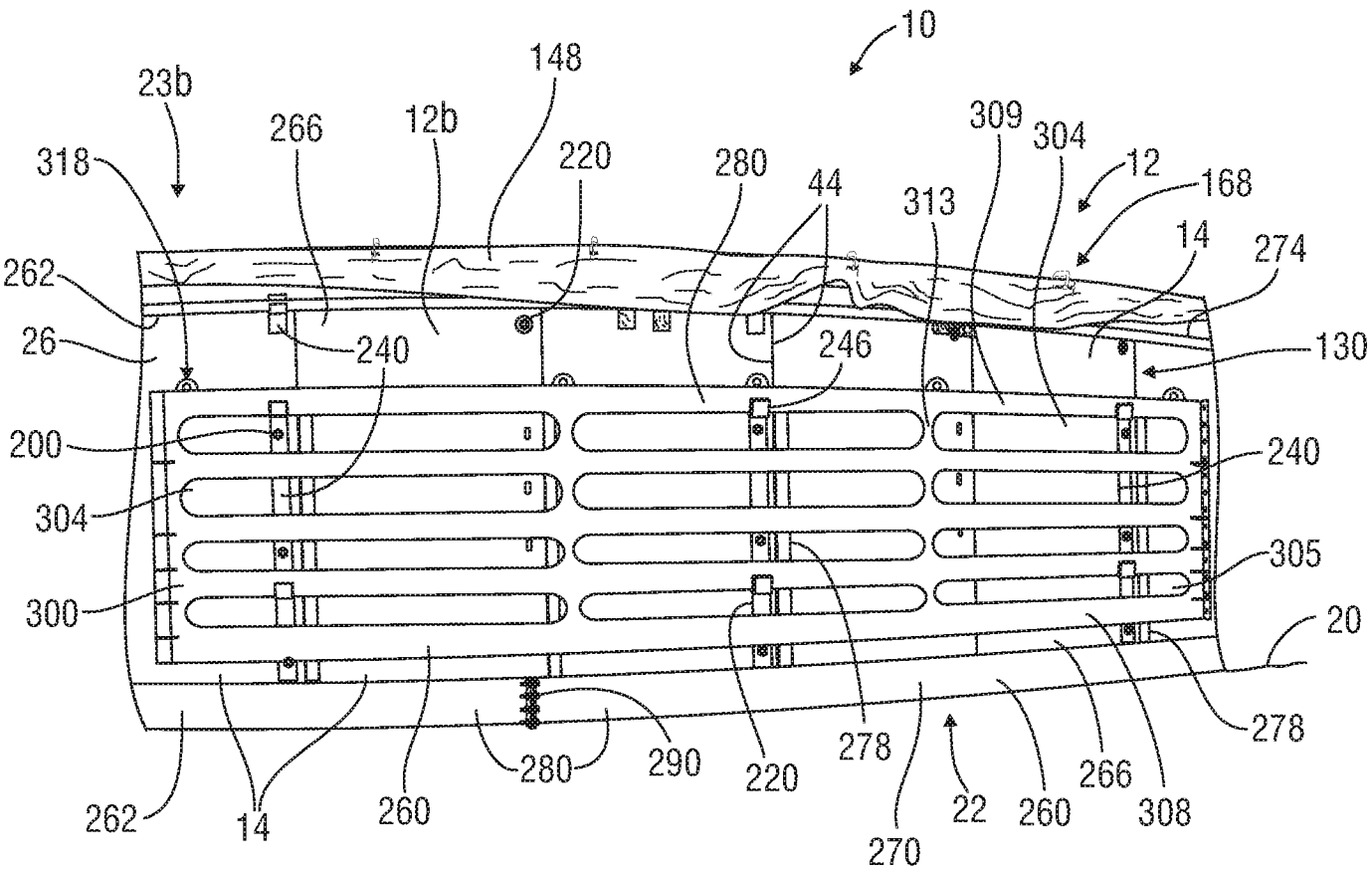
FIG. 27 is a perspective view of part of an exemplary large-capacity holding container employing another embodiment of a support system in accordance with one or more embodiments of the present disclosure.

Still referring to FIGS. 13A-C, when included, the horizontal brace(s) 260 may extend around the wall 12 across the entirety of the height 21 of the wall 12 (e.g. from the lower edge 23*a* to the upper edge 23*b*) or only along one or more portions of the height 21 of the wall 12. The effective use of horizontal braces 260 along only one or more portions of the height 21 of the wall 12 may be possible due to the material construction, internal structure, dimensions, strength and/or flexibility of the panels 14 such as described above, rendering the panels 14 capable of supporting the load of the contents of the storage area(s) 13 along parts of the wall 12 not directly supported by the support system 22. For example, the illustrated holding container 10 includes multiple distinct horizontal braces 260 configured to be spaced apart from one another at different elevations on the wall 12 and forming gaps 266 therebetween. Thus, the exemplary panels 14 are configured to sufficiently support the load of the contents of the storage area(s) 13 in the gaps 266 between the horizontal braces 260. Multiple spaced-apart horizontal braces 260 may be desirable, for example, to minimize the size and weight of the components of the holding container 10, for ease of manufacture, handling, storage, transportability and assembly of the holding container 10, other desired purpose(s) or a combination thereof. If desired, as shown in FIG. 27, the support system 22 may also or instead include one or more vertical braces 278 to assist in reinforcing the wall 12, provide a good fit between the panels 14 and the horizontal brace(s) 260, other desired purpose or a combination thereof.

The horizontal brace(s) 260, when included, may have any suitable form, configuration, dimensions and operation. In various embodiments, one or more of the horizontal braces 260 may include at least one tie rod, strap, cord, cable, rebar, belt, bar, wire or the like constructed of any one or more desired (rigid or flexible) materials (e.g. steel, composite material, graphite, etc.). In the preferred embodiments, each horizontal brace 260 is a band 262 configured to extend around the wall 12. The band 262 may have any suitable form, configuration, dimensions and operation. For example, the band 262 may be elongated, constructed of steel and formed with a minimal thickness to allow the band 262 to bend, or develop curvature, as desired to conform to the overall shape (e.g. cylindrical or ring-like shape) of the wall 12 during assembly and/or use of the holding container 10, to minimize the size and weight of the components of the support system 22, for ease of manufacture, handling, storage, transportability and assembly of the support system 22, but still be thick enough to provide the desired load support, for any other desired purpose(s) or a combination thereof. In the illustrated holding container 10, each band 262 has a thickness of approximately 0.5". However, the band 262 may possess any other thickness (e.g. ⅛", 3/16", ¼", ⅝" or more or less). Further, when multiple bands 262 are used at different elevations on the wall 12, the different bands 262 may have different thicknesses. For example, the thickness of the lowermost band 270 may be greater than the thickness of the other bands 262 and/or the uppermost band 274 may have a smaller thickness (e.g. from approximately ¼"-approximately ⅜") than the other bands 262, such as when the amount of load placed upon the wall 12 by the contents of the storage area(s) 13 is expected to generally decrease going up the wall 12. In use of the preferred embodiment, it has been shown that the load generally increases going down the wall 12, with the greatest load bearing upon the wall 12 at the bottom of the wall 12 (closest to the lower edge 23*a*) and the smallest load on the wall 12 at the upper end of the wall 12 (closest to the upper edge 23*b*).

Still referring to FIGS. 13A-C, when horizontal braces 260 are used, the type, quantity, size, configuration and spacing of multiple spaced-apart horizontal braces 260 (e.g. bands 262) may be determined based upon any suitable criteria, such as to sufficiently support the expected load of the contents of the storage area(s) 13 acting on the wall 12 while minimizing the size and weight of the components of the support system 22, for ease of manufacture, handling, storage, transportability and assembly of the support system 22, other desired purpose(s) or a combination thereof. Thus, any number and form of horizontal braces 260 may be used. In this particular embodiment, seven distinct elongated horizontal braces 260 (e.g. bands 262) are shown positioned at different heights on the wall 12. However, any suitable number of bands 262 (and/or other types of horizontal braces 260) may be used (e.g. 1, 2, 3, 4, 5, 6, 8, 9 etc.). For example, when the exemplary wall 12 is formed with panels 14 stood upright widthwise, fewer bands 262 (and/or other horizontal braces 260) will likely be necessary (e.g. the uppermost band 274 placed adjacent or proximate to the upper edge 23*b* of the wall 12 may be unnecessary). Further, in other embodiments, different types of horizontal braces 260 may be used at different heights along the wall 12 and/or in any desired combination (e.g. a wire brace supporting a band 262), or a single horizontal brace 260 may be used along all or part of the height 21 of the wall 12.

When multiple horizontal braces 260 (e.g. bands 262) are used, the horizontal braces 260 may be formed with differing widths. For example, since the amount of load placed upon the wall 12 and support system 22 of the exemplary holding container 10 by the contents of the storage area(s) 13 is expected to generally decrease going up the wall 12: (i) the width 276 (e.g. approximately 4"-9") of the uppermost exemplary band 274 (e.g. FIGS. 27 & 30) on the wall 12 (e.g. placed adjacent or closest to the upper edge 23*b* of the wall 12) may be smaller than the width each of the other bands 262 (e.g. FIG. 15); (ii) the width of all the bands 262, other than the lowermost band 270 (placed adjacent or closest to the lower edge 23*a* of the wall 12), may be less than the width 272 (e.g. approximately 16"-21") of the lowermost band 270 (e.g. FIGS. 14 & 29); (iii) the width of each intermediate band 262 (between the uppermost and lowermost bands 274, 270) may be equal to or smaller than the width of each of the bands 262 below it; or a combination thereof. However, the bands 262 may have any other desired width, or may all possess the same width.

Still referring to FIGS. 13A-C, if desired, the bands 262 may be formed of separate, releasably interconnectable band sections 280, such as to minimize the size and weight of the components of the support system 22, for ease of manufacture, handling, storage, transportability and assembly of the support system 22, other desired purpose(s) or a combination thereof. In the preferred embodiment, the exemplary band sections 280 of each respective band 262 are elongated and configured to be positioned adjacent to one another side-by-side around the outer perimeter 19 of the wall 12 and interconnected to form the respective band 280.

The band sections 280, when included, may have any suitable form, configuration, dimensions and operation. For example, the band sections 280 may be flat, such as for ease of manufacturing, handling, storage, transportation and assembly and capable of bending to conform to the shape of the holding container 10. However, in other embodiments, all or some of the band sections 280 may be formed with curvature, protrusions, projections or other features. Any desired number of band sections 280, each having any desired length, may be used to form each band 262. In the preferred embodiment of a holding container 10 having an overall cylindrical or ring-shaped wall 12 with a circumference of approximately 250' constructed of fifty exemplary panels 14, each band 262 includes nine band sections 280 each having a length 294 of approximately 34', and one short band section 285 (e.g. FIG. 13A) having a smaller length (e.g. 33' 6") to enable tensioning of the band 262 around the wall 12 and/or any other purpose(s). In other embodiments, all the band sections 280 of each band 262 may have the same length 294, different band sections 280 of the same band 262 may have the different lengths or any combination thereof.

Still referring to FIGS. 13A-C, in this example, the length 294 (e.g. approximately 33'-34') of each band section 280 is sized to span across approximately five interconnected panels 14 of the wall 12. Thus, the holding container 10 could be sized in any desired number of interconnected panels 14 in increments of five panels. For example, the wall 12 of the holding container 10 with the exemplary band sections 280 could be constructed of twenty, twenty-five, thirty, thirty-five, forty, forty-five, fifty, fifty-five, etc. panels 14, providing great flexibility in selecting or varying the size and capacity of the holding container 10 (e.g. approximately 20,000 barrels, 40,000 barrels, 60,000 barrels, 80,000 barrels, etc.) and may be customized at the installation site and between different sites. In other embodiments, the length 294 of some or all of the band sections 280 could be less than approximately 34' to fit a smaller number of interconnected panels 14 (e.g. one, two, three, four), providing even greater flexibility in selecting, changing or customizing the size, shape, footprint and capacity of the holding container 10 at the installation site or between uses at different sites or for any other purpose(s). In other embodiments, the band sections 280 could be more than 34' long for any desired purpose. Further, any other desired number of band sections 280, each having any desired length, may be used to form each band 262.

Referring now to FIGS. 14 & 15, when included, the band sections 280 of each distinct band may be interconnectable in any suitable manner. In this embodiment, each band section 280 includes at least one connection interface 286 positioned proximate to each side edge 282, 284 thereof. In the preferred embodiment, each connection interface 286 includes at least one aperture 288 formed in the respective band section 280 proximate to one of the side edges 282, 284 thereof. However, the connection interfaces 286 may have any other desired form and components, such as one or more protrusions, mateable members, clips, pins, etc. In assembling any of the exemplary bands 262, at least one connection interface 286 at the right side edge 284 of each band section 280 is configured to be positioned proximate to and releasably coupled with at least one connection interface 286 at the left side edge 282 of an adjacent band section 280 to form the band 262 (e.g. FIG. 13B). It should be noted that in embodiments of horizontal braces 260 (e.g. bands 262) not using multiple sections (e.g. band sections 280), the connection interfaces 286 at the ends of the same horizontal brace 260 (e.g. band 262) may be interconnected to form the horizontal brace 260. Further, the description herein of the connection interfaces 286 and related components is equally applicable to other types and configurations of horizontal braces 260.

In the preferred embodiment, depending upon the length 294 of the band sections 280 for a particular band 262, the circumference of the wall 12 and the desired tension (if any) to be placed upon the band 262, a gap may exist between one or more of the adjacent band sections 280 of each band 262 during (and potentially after) assembly of the holding container 10. For example, a gap of approximately 6" may be formed between the short band section 285 and the adjacent band section 280 of each band 262 to complete assembly of the band 262 around the wall 12. If desired, the respective connection interfaces 286 of at least some of the adjacent band sections 280 of a band 262 may be configured to be selectively moveable relative to one another to draw the adjacent band sections 280 toward and away from one another to respectively tighten and loosen the band 262 around the wall 12.

Referring again to FIGS. 13A-C, the respective connection interfaces 286 of adjacent band sections 280 may be releasably coupled together and/or moveable relative to one another in any suitable manner. For example, a band coupler 290 may be configured to selectively, releasably engage at least one adjacent pair of connection interfaces 286 of respective adjacent band sections 280 of a particular band 262. In some instances, the band coupler 290 may be selectively adjusted to draw the adjacent band sections 280 toward and away from one another. In this embodiment, each band coupler 290 is a pin 292 extendable through an adjacent pair of apertures 288 of adjacent band sections 280 of a particular band 262 (see also e.g. FIGS. 24B-C). The illustrated pin 292 is selectively tightenable to secure the band sections 280 together. If a gap exists between adjacent band sections 280, the exemplary pin 292 can be selectively tightenable to draw the band sections 280 toward one another to tighten their interconnection and the band 262 around the wall 12. For example, the pin 292 may be a bolt 293 selectively tightenable and secured in place with at least one nut. If desired, one or more washers may be used at either or both ends of the bolt 293 (or other form of pin 292). In some embodiments, the bolt 293 may have a diameter of approximately 1" and a length ranging from approximately 3"-8". A longer bolt 293 (or other form of pin 292) may be necessary or desirable when there is a gap between adjacent band sections 280. In the preferred embodiment, the length of the bolt 293 used to connect the short band section 285 to an adjacent band section 280 may be approximately 8", while the bolts 293 used to interconnect the other adjacent band sections 280 may be approximately 3"-4". However, the pin 292 (or other forms of band couplers 290) may include any other components, such as one or more clip, cotter pin, clamp, etc. and operation or may not be included.

When included, tensioning of the horizontal brace(s) 260 around the wall 12 may be desirable, for example, to form a tight fit of the horizontal brace 260 to the panels 14 and/or force the panels 14 and horizontal braces 260 at least partially in abutting contact with one another around the outer perimeter 19 of the wall 12, allowing or encouraging load acting on the wall 12 from the contents (e.g. liquid) of the storage area 13 to pass to the horizontal braces 260 and minimizing the potential for weak points or areas forming on the panels 14 (e.g. if the panels 14 do not abut the horizontal braces 260), other purpose or a combination thereof. Thus, in some embodiments, a snug fit of the horizontal brace(s) 260 and panels 14 is preferred to allow the horizontal brace(s) 260 to bear as much of the load as possible and avoid creating weak areas on the panels 14. In the present embodiment, it may be desirable to pre-load the horizontal braces 260 with tension around the wall 12 before the contents (e.g. liquid) are placed into the holding container 10 so the panels 14 will be likely to expand, flex or move outwardly into the desired contact with the horizontal braces 260 when the holding container 10 is (at least partially) filled. However, in other embodiments the horizontal braces 260 may not be tensioned around the wall 12.

Still referring to FIGS. 13A-C, any suitable technique and components may be used to tension the horizontal brace(s) 260. In the preferred embodiment, the tightening of one or more band couplers 290, particularly when connecting the last band section 280 (e.g. the short band section 285) to complete the band 262, will tension the horizontal brace(s) 260. Due to the material construction, internal structure, strength and flexibility of the exemplary panels 14 and their ability to float, the band couplers 290 may be tightened sufficiently to ultimately create or encourage a snug fit with the panels 14. For other examples, one or more Belleville washer, ratchet mechanism or the like may be connected between at least two of the interconnected band sections 280 (or other forms of horizontal braces 260) to assist in tightening and tensioning the horizontal brace 260.

Referring back to FIGS. 14 & 15, if desired, any one or more of the exemplary band sections 280 may include multiple connection interfaces 286 proximate to one or both side edges 282, 284 thereof, and multiple band couplers 292 (e.g. FIG. 24C) may be used to couple adjacent band sections 280 together. For example, at elevations, or portions, along the height 21 on the wall 12 expecting greater load, it may be desirable to include more connection interfaces 286 and/or band couplers 292 than at other locations. In the preferred embodiment, more connection interfaces 286 and/or more band couplers 292 are desirable for connecting each horizontal brace(s) 260 closest to the lower edge 23*a* of the wall 12 (e.g. lowermost band 270) when greater stress and forces from the contents of the storage area 13 bearing upon the panels 14 is expected at the bottom of the wall 12. Each illustrated band section 280 of the lowermost band 270 includes four connection interfaces 286 (e.g. FIG. 14) shown coupled together with four band couplers 292 (e.g. FIG. 13B). The band sections 280 of the other illustrated bands 262 (e.g. FIG. 15) each include three connection interfaces 286 shown coupled together with three band couplers 292 (e.g. FIG. 13B). However, any suitable number of connection interfaces 286 and band couplers 292 may be used (e.g. 1, 2, 5, 6 or more). For example, the band section 280 shown in FIG. 23B includes thirteen connection interfaces 286 proximate to each side edge 282, 284 thereof, while the band section 280 shown in FIG. 28 includes twenty-two connection interfaces 286 proximate to each side edge 282, 284 thereof. In some instances, the number of band couplers 292 to be used in each horizontal brace 260 of a particular holding container 10 may be determined based upon the particular use scenario.

Figures 24A, 24B, 24C:
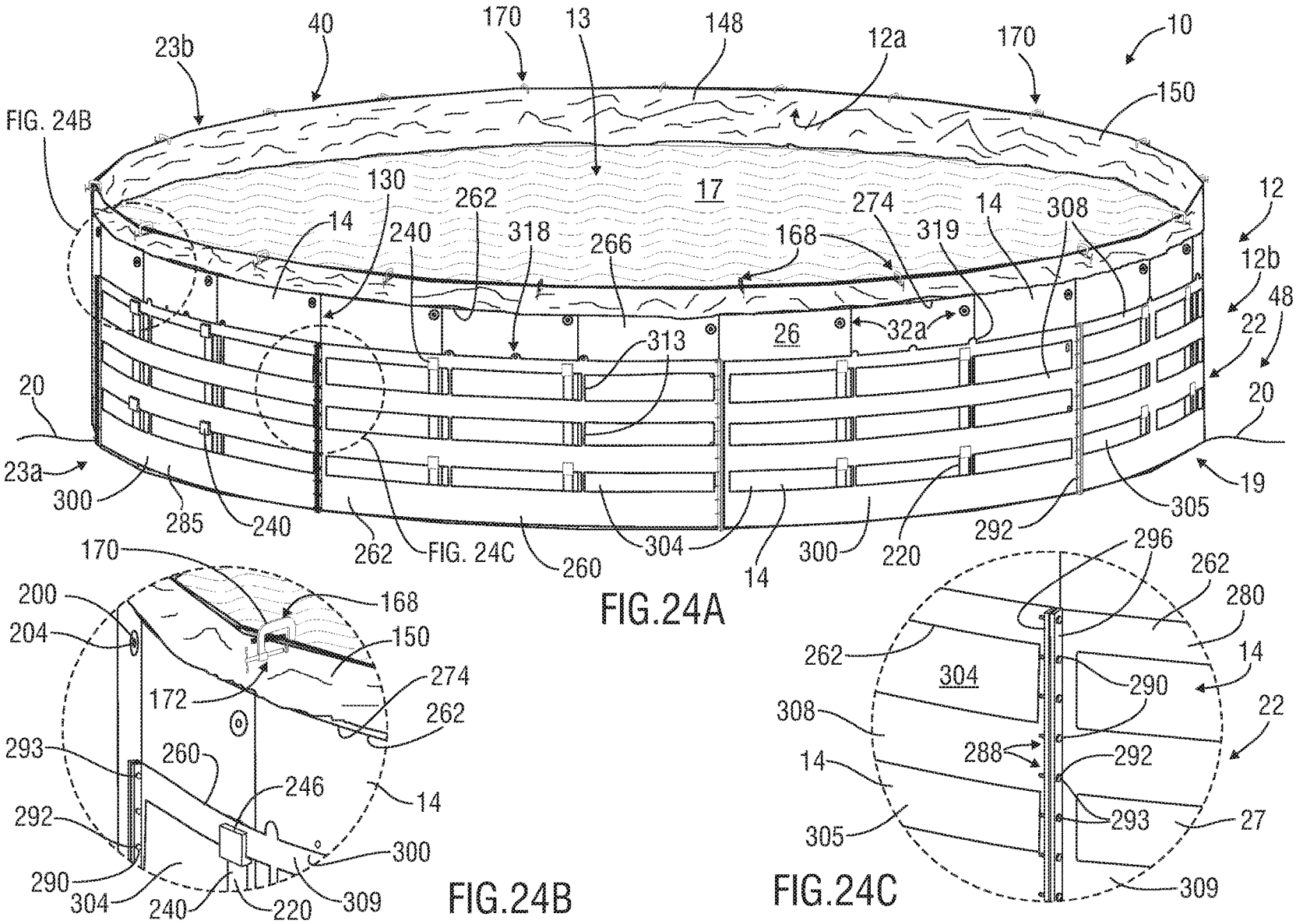
FIG. 24A is a perspective view of an exemplary large-capacity, modular, holding container employing an exemplary support system that includes the hardware shown in FIGS. 22A & 23A in accordance with one or more embodiments of the present disclosure.
FIG. 24B is an exploded view of part of the exemplary large-capacity holding container of FIG. 24A.
FIG. 24C is an exploded view of another part of the exemplary large-capacity holding container of FIG. 24A.

Referring still to FIGS. 14 & 15, when included, the exemplary connection interfaces 286 may be provided proximate to either or each side edge 282, 284 of each band section 280 in any suitable manner. In this embodiment, the connection interface(s) 286 are formed in one or more outwardly projecting flanges 296 disposed at, or proximate to, each side edge 282, 284 thereof. As shown in FIG. 24C, for example, the adjacent flanges 296 of adjacent band sections 280 are configured to be drawn into abutting contact with one another to tighten the exemplary band 262 around the outer perimeter 19 of the wall 12. The flanges 296 may have any suitable form, configuration, dimensions and operation. For example, the flanges 296 may be configured to support the stresses placed upon the band couplers 292. In the preferred embodiment, substantial stress may be placed upon the band couplers 292 and thus onto the flanges 296 due to substantially tensioning the bands 262 around the wall 12 during assembly of the holding container 10 to create a snug fit or place at least some of the panels 14 in compression, load of the contents of the storage area 13 bearing upon the panels 14 during use of the holding container 10, other variables or a combination thereof. To withstand the expect stresses, the exemplary flanges 296 may be formed of steel, have a thickness of approximately ⅝" and supported by multiple diagonal braces, or gussets, 298. The gussets 298 may have any suitable form, configuration and location. In this embodiment, multiple spaced-apart gussets 298 extend from an outer surface 297 of the band section 280 to each flange 296, such as to support the flange 296 and/or prevent it from failing or undesirably bending or deforming. Any desired or suitable number of gussets 298 may be included. For example, each exemplary flange 296 of FIG. 14 includes five gussets 298, each exemplary flange 296 of FIG. 15 includes four gussets 298 and each exemplary flange 296 of FIG. 28 includes ten gussets 298.

Now referring to FIGS. 24A-C, the horizontal brace(s) 260, when included, may be supported, or held, at the desired position relative to the wall 12 and around the outer perimeter 16 thereof in any suitable manner. In the preferred embodiment, a plurality of attachment brackets 240 is used to releasably hold the horizontal brace(s) 260 in position. The attachment brackets 240 may have any suitable form, configuration, construction and operation. Each exemplary attachment bracket 240 is configured to be releasably coupled to and extend from the wall 12 at a desired location along the height 21 of the wall 12 and at least partially support at least one horizontal brace 260 at a desired elevation. For example, each illustrated horizontal brace 260 may be supported by numerous attachment brackets 240 spaced apart around the outer perimeter 19 of the wall 12. The quantity and size of the attachment brackets 240 may be determined based upon the size of the holding container 10, weight of the horizontal brace 260 (e.g. band sections 280), the load expected to be placed on the wall 12 by contents of the storage area(s) 13, any other variable(s) or a combination thereof. Thus, any desired number of attachment brackets 240 (or other components) may be used to support each horizontal brace 260. For example, an attachment bracket 240 may be provided for each horizontal brace 260 at every second pair of interconnected panels 14 around the outer perimeter 19 of the wall 12. In that instance, an exemplary holding container 10 having fifty panels 14 would utilize a total of twenty-five attachment brackets 240 for each horizontal brace 260. In some embodiments, the attachment brackets 240 may be integral, or rigidly coupled, to the panels 14, horizontal braces 260 or other components, or not included.

Figures 22A, 22B, 23A, 23B:
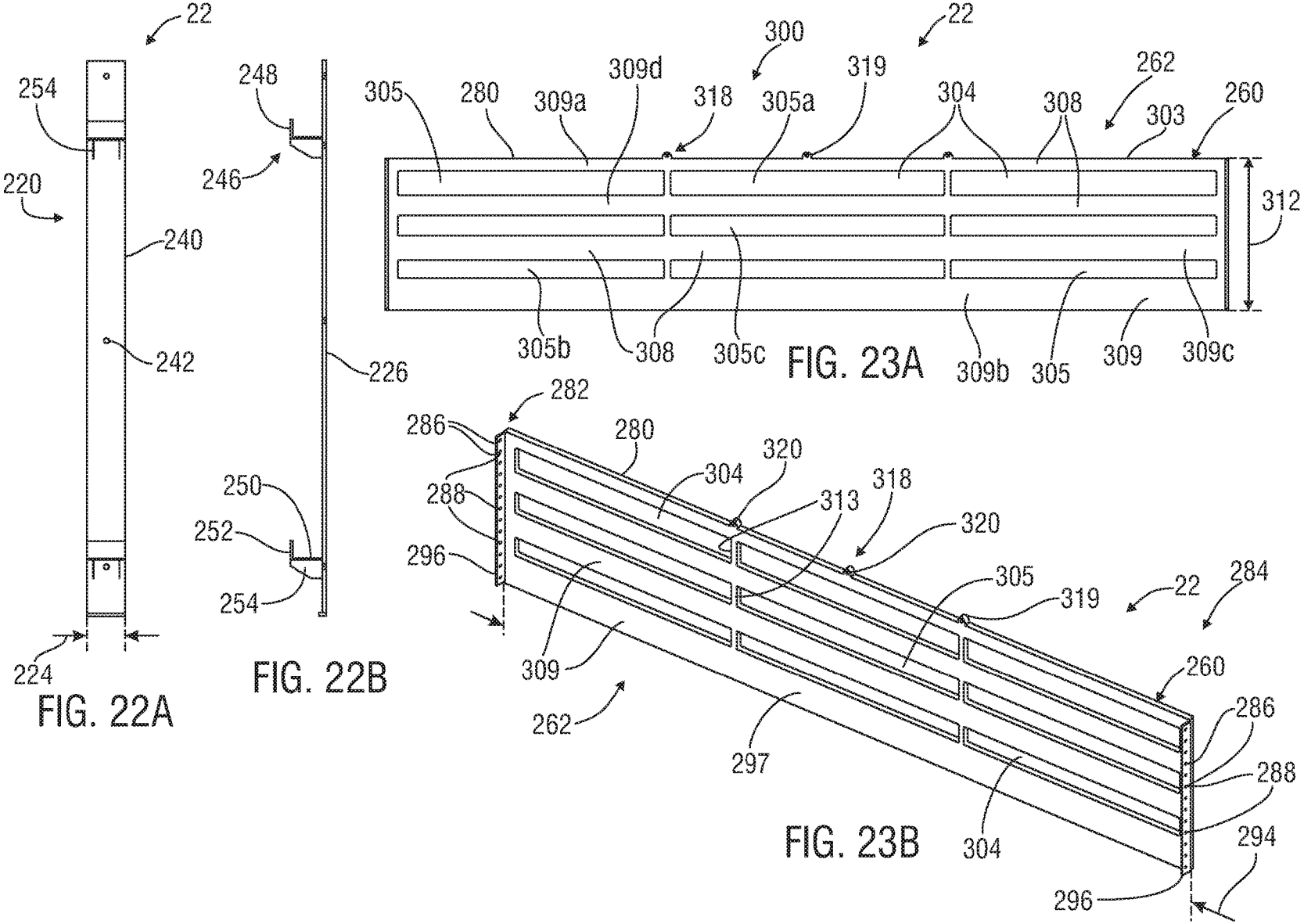
FIG. 22A is a front view of another exemplary attachment bracket in accordance with one or more embodiments of the present disclosure.
FIG. 22B is a side view of the exemplary attachment bracket shown in FIG. 22A.
FIG. 23A is a front view of another exemplary horizontally-extending connector in accordance with one or more embodiments of the present disclosure.
FIG. 23B is a perspective view of the exemplary horizontally-extending connector shown in FIG. 23A.
Figure 26:
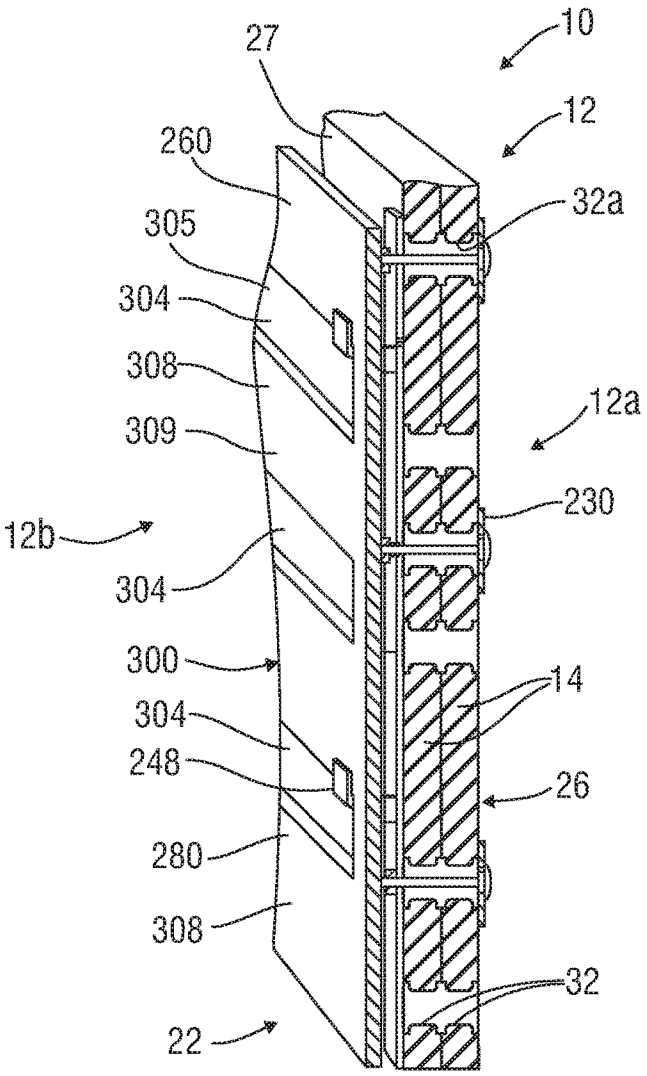
FIG. 26 is a cross-sectional view of part of the exemplary large-capacity holding container of FIG. 24A after attachment of the exemplary horizontally-extending connector.
Figures 28, 29, 30, 31A, 31B:
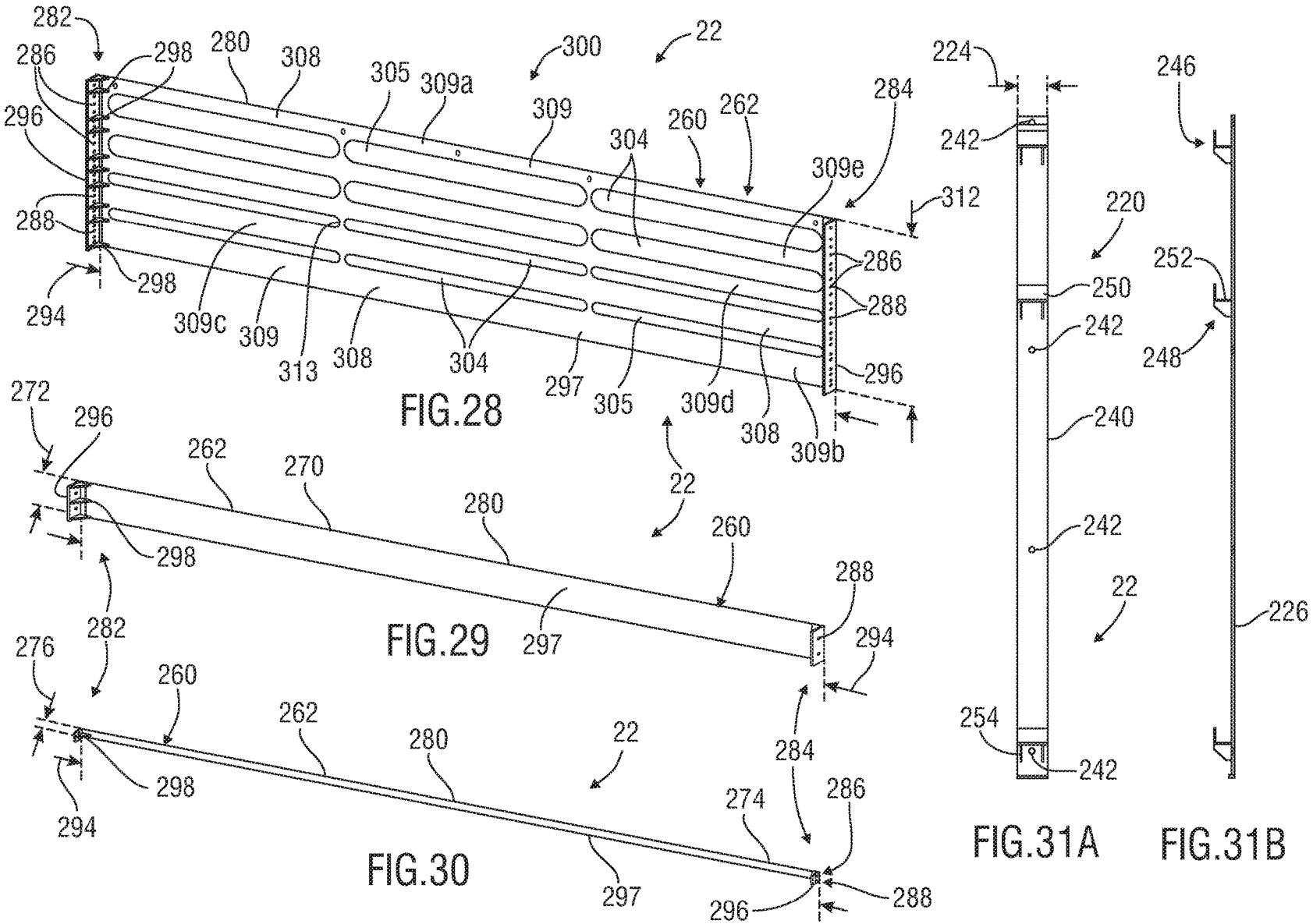
FIG. 28 is a perspective view of another exemplary horizontally-extending connector in accordance with one or more embodiments of the present disclosure.
FIG. 29 is a perspective view of another exemplary horizontally-extending connector in accordance with one or more embodiments of the present disclosure.
FIG. 30 is a perspective view of another exemplary horizontally-extending connector in accordance with one or more embodiments of the present disclosure.
FIG. 31A is a front view of another exemplary attachment bracket in accordance with one or more embodiments of the present disclosure.
FIG. 31B is a side view of the exemplary attachment bracket shown in FIG. 31A.

Referring to FIGS. 25 & 26, when included, each exemplary attachment bracket 240 may be configured to extend from the outer side 12*b* of the wall 12 to at least partially support at least one horizontal brace 260. In this embodiment, each attachment bracket 240 is configured to be coupled to at least one panel 14 at the desired elevation by at least one of the panel connectors 200. For example, the attachment brackets 240 of FIGS. 16A, 17A and 18A are vertically-oriented and each include one or more panel connection orifices 242 for receiving a panel connector 200 to releasably couple the attachment bracket 240 to a pair of adjacent, interconnected panels 14. The exemplary attachment bracket 240 of FIG. 22A is also vertically-oriented and includes panel connection orifices 242 at different elevations (see e.g. FIG. 25) for receiving three vertically spaced-apart panel connectors 200 extendable through vertically aligned receptacles 32 of a pair of adjacent interconnected panels 14. In FIG. 31A, the attachment bracket 240 is also vertically-oriented and includes four vertically spaced-apart panel connection orifices 242 at four different heights. In other embodiments, the attachment brackets 240 may be horizontally-oriented (e.g. having one or multiple generally horizontally spaced-apart panel connector orifices 242) and coupled to one or multiple sets of adjacent, interconnect panels 14 (e.g. similarly as in the manner described above). Thus, each attachment bracket 240 may include any desired number of panel connection orifices 242 (e.g. 1, 2, 3, 4, 5 or more) at any desired elevations. Further, in some embodiments, the horizontal braces 260 may be coupled to or associated with the wall 12 in a different manner and/or without the use of attachment brackets 240.

Referring again to FIGS. 25 & 26, in the present embodiment, each attachment bracket 240 is shown sandwiched between the releasable lock 210 and the outer side 12*a* of the wall 12. As mentioned above, the exemplary attachment bracket 240 may also serve as an intermediate plate 220 by surrounding the panel connector 200 and providing a sliding surface 226 for the corresponding interconnected pair of panels 14 to float. For example, in this embodiment, each attachment bracket 240 has a width of approximately 6" and a height of at least 6".

The exemplary attachment bracket 240 may at least partially support, or hold, at least one horizontal brace 260 in any suitable manner. In this embodiment, each attachment bracket 240 includes at least one retainer 246 configured to releasably engage, or hold, a horizontal brace 260 and retain it in position at a desired height of the wall 12. The retainer 246 may have any suitable form, configuration and operation. The exemplary retainer 246 is an L-shaped hook 248 upon which a horizontal brace 260 (e.g. band 262 or band section 280) may be hung. The illustrated hook 248 includes a base 250 extending outwardly from the attachment bracket 240 and a lip 252 projecting generally upwardly from the base 250. If desired, one or more diagonal braces, or gussets, 254 may extend between the hook 248 (e.g. base 250) and the attachment bracket 240, such as to assist in supporting the weight of the horizontal brace 260, preventing the hook 248 from undesirably bending, warping or breaking, other desired purpose(s) or a combination thereof. However, the retainer 246 may take any other form or include any other component (e.g. clip, rod, connector, pin, etc.), and the hook 248, when included, may have any other suitable configuration. In some embodiments, retainers 246 may not be included.

Referring still to FIGS. 25 & 26, the exemplary retainer 246 may have any desired construction and dimensions. In this embodiment, each hook 248 is a section of 4"×4" angle iron, so the base 250 is 4" wide and the lip 252 is 4" tall. In some embodiments, one or more of the retainers 246 may be configured to assist in positioning the associated horizontal brace(s) 260 in abutting contact with, or proximate to, the outer surface 12*b* of the wall 12 to encourage the panels 14 to be snug against the horizontal brace(s) 260, allow the horizontal brace(s) 260 to support much the load of the contents of the storage area(s) 13 acting on the wall 12, for any other purpose(s) or a combination thereof. For example, the width of the base 250 of the hook 248 may be equal to or slightly larger than the thickness (e.g. ½") of the horizontal brace 260 (e.g. band 262 or band section 280).

Referring now to FIGS. 16A-18B, in various embodiments, all or some of the attachment brackets 240 may include multiple retainers 246 to support the same and/or multiple horizontal braces 260. In FIGS. 16A & 17A, for example, each attachment bracket 240 includes two vertically spaced-apart retainers 246 to releasably engage a different horizontal brace 260, respectively. In this embodiment, the retainers 246 and panel connection orifices 242 are positioned to support one or more distinct bands 262 on the wall 12. The illustrated attachment bracket 240 of FIG. 16A-B is configured to releasably engage the lowermost band 270 and the next highest band 262. The exemplary attachment bracket 240 of FIG. 17A-B is configured to releasably engage two intermediate position bands 262 on the wall 12, and the attachment bracket 240 of FIG. 18A-B is configured to releasably engage the uppermost band 274 on the wall 12 (e.g. FIG. 13C). In FIGS. 22A-B, 24A, 26, 27 and 31A-B, each illustrated attachment bracket 240 includes two vertically spaced-apart retainers 246 to releasably engage a different solid section 308 of an exemplary tall band 300 (described below). In other embodiments, the attachment bracket 240 may include more than one horizontally spaced-apart, or adjacent, retainer 246 to support the same horizontal brace 260. In yet other embodiments, the attachment bracket 240 may include any combination of horizontally aligned, or spaced-apart, retainers 246 and vertically aligned, or spaced-apart, retainers 246 to support one or more horizontal braces 260.

Now referring to FIGS. 23A-24C, in some embodiments, the horizontal brace 260 may include a form of band 262 referenced herein as a tall band 300 configured to extend along a wide portion of the height 21 of the wall 12 and have one or more of the features described above and shown in the appended drawings with respect to the horizontal brace 260, band 262 and related components. For example, the tall band 300 may include multiple band sections 280 having the same features as the exemplary band sections 280 and interconnected with the exemplary attachment brackets 340 as previously described, except as may be specified differently below. Thus, the above description of the horizontal brace(s) 260, band(s) 262 and all related components is incorporated herein by reference with respect to the exemplary tall band 300.

The use of one or more tall bands 300 may be desirable, for example, to replace multiple of the individual bands 362 and thus reduce the number of components in the support system 22, expedite and simplify manufacture, handling, storage and transportability of the support system 22 and assembly of the holding container 10, for other desired purpose(s) or a combination thereof. The tall band 300 may have any desired dimensions, components, configuration and operation. The tall band 300 may be used, for example, to extend along at least one-third, one-half, five-eights, three-quarters, seven-eighths, or any other desired height section, or the entire height 21, of the wall 12. In some embodiments, only one tall band 300 may be used or needed along at least part of the height 21 of the wall 12, while in other embodiments, one or more additional horizontal braces 260 (e.g. band 262 and/or another tall band 300) may be included. The tall bands 300 may be used with one or more other separate bands 362 (or other braces 360), such as to avoid a component width that would exceed the size limits of non-permitted transportation, limit the size and weight of the tall bands 300 for handling, storage and transportation, other desired purpose(s) or a combination thereof. In FIG. 24A, for example, the support system 22 includes a tall band 300 that extends up from the lower edge 23*a* of the wall 12 and a separate uppermost band 274 proximate to the upper edge 23*b* of the wall 12. For another example, in FIG. 27, the support system 22 includes a tall band 300 spaced upwardly from a distinct lowermost band 270 and downwardly from a distinct uppermost band 274.

Referring back to FIGS. 23A-24C, the exemplary tall band 300 may have any desired length and width. Regarding length, each exemplary tall band 300 includes nine band sections 280 each having a length 294 of approximately 34', and one short band section 285 (e.g. FIG. 14A) having a smaller length (e.g. 33' 6") to enable tensioning of the band 300 around the wall 12. In other embodiments, all the band sections 280 for each tall band 300 may have the same length 294 and/or different band sections 280 of the same tall band 300 may have different lengths. As to width, each band section 280 of the exemplary tall bands 300 of the preferred embodiment has a width 312 of under 102". However, any other dimensions may be used.

If desired, the exemplary tall band 300 may be formed with one or more cut-outs 304, such as to reduce the size and weight of the tall band 300 and/or other desired purpose(s). In various embodiments, the use and effectiveness of tall bands 300 with cut-outs 304 may be possible due to the material construction, internal structure, dimension, strength and/or flexibility of the panels 14 such as described above, rendering the panels 14 capable of supporting the load of the contents in the storage area(s) 13 on the wall 12 at the cut-outs 304 in each tall band 300. In the exemplary embodiments, the tall band 300 includes a series of solid sections 308 extending between the cut-outs 304. When included, the cut-outs 304 and solid sections 308 may have any desired shape, location and configuration. For example, the illustrated tall band 300 includes multiple elongated cut-outs 305 extending lengthwise at least partially across the length 294 of each tall band section 280, spaced apart from one another along the width 312 of the tall band 300 and separated by multiple elongated solid sections 309. In the illustrated embodiments, the elongated solid sections 309 function similarly as the individual bands 262 as previously described.

Still referring to referring to FIGS. 23A-24C, two or more elongated cut-outs 305 may be formed adjacent to one another side-by-side across at least part of the length 294 of each exemplary tall band section 280 and separated by intermediate solid sections 313. In this embodiment, each tall band section 280 is shown having three side-by-side elongated cut-outs 305 on each row of elongated cut-outs 305. Each pair of illustrated side-by-side elongated cut-out 305 is separated by an intermediate solid section 313. The exemplary intermediate solid sections 313 essentially connect the elongated solid sections 109 above and below each row of elongated cut-outs 305, such as to provide a desired amount of stiffness and support to the tall band 300, prevent undesirable bending, warping, cracking or breaking of the tall band 300, other desired purpose(s) or a combination thereof.

The tall band 300 may include any desired quantity of cut-outs 305 and solid sections 308. In this embodiment, each tall band section 280 is shown having three rows of elongated cut-outs 305 with three side-by-side elongated cut-outs 305 on each row. A total of four exemplary elongated solid sections 309 and twelve (12 ea.) intermediate solid sections 313 are formed around and between the elongated cut-outs 305. For other examples, in FIGS. 27 & 28, each tall band section 280 is shown having four rows of elongated cut-outs 305 with three side-by-side elongated cut-outs 305 on each row. A total of five exemplary elongated solid sections 309 are formed around and between the elongated cut-outs 305 and sixteen intermediate solid sections 313 are formed around and between elongated cut-outs 305. Other embodiments may include one, two, five, six or more rows of elongated cut-outs 305, two, three, six or more elongated solid sections 309, fewer than twelve, thirteen, fourteen, fifteen or more than sixteen intermediate solid sections 313, any other number of cut-outs 304 and/or solid sections 308 of any shape and configuration, or a combination thereof. For example, all or some of the cut-outs 304 and or solid sections 308 of a tall band 300 may have a circular, triangular, hexagonal, oval or random shape and/or a random arrangement on the tall band 300. Thus, the tall bands 300 of the present disclosure and appended claims are not limited to use with only elongated cut-outs 305, elongated solid sections 309 and intermediate solid sections 313 of any certain quantity and arrangement, except and only to the extent as may be expressly recited and explicitly required in a particular claim hereof and only for such claim(s) and any claim(s) depending therefrom.

Referring still to FIGS. 23A-24C, when included, the solid sections 308 may have any suitable dimensions. If desired, the respective widths of the elongated solid sections 309 of a tall band 300 may be varied similarly as the widths of the different horizontal braces 260 (e.g. bands 262) used in a holding container 10 having multiple horizontal braces 260, such as described above. For example, when the amount of load placed upon the wall 12 of the exemplary holding container 10 by the contents of the storage area(s) 13 is expected to generally decrease going up the wall 12: (i) the width of the uppermost exemplary elongated solid section 309*a* of a tall band 300 may be smaller than the width of each of the other solid sections 308 of the tall band 300; (ii) the width of all the solid sections 308 other than the lowermost solid sections 309*b* may be less than the width of the lowermost solid sections 309*b* of the tall band 300, (iii) the width of each intermediate solid section 308 (between the uppermost and lowermost solid sections 309*a*, 309*b*) may be equal to or smaller than the width of each solid section 308 below it, or a combination thereof. If the tall band 300 is used with one or more other separate bands 262 (or other forms of horizontal braces 260), the width of one or more solid sections 308 of the tall band 300 may vary as compared to the width of each of the other band(s) 262 (or other forms of horizontal braces 260).

In the preferred embodiment, the width of the lowermost exemplary elongated solid section 309*b* is larger than the width of the other elongated solid sections 309 of the tall band 300, and the width of the uppermost elongated solid section 309*a* is smaller than the other elongated solid sections 309 of the tall band 300. The exemplary tall band 300 is shown positioned on the wall 12 with the lower most section 309*b* proximate to the lower edge 23*a* of the wall 12 and a separate uppermost band 274 positioned proximate to the upper edge 23*b* of the wall. Further, in this embodiment, the widths of the respective elongated solid sections 309 are graduated as follows: the uppermost elongated solid section 309*a* has a width (e.g. approximately 6") that is smaller than all the other elongated solid sections 309, the lowermost elongated solid section 309*b* has a width (e.g. approximately 14") that is greater than all the other elongated solid sections 309, the second lowest elongated solid section 309*c* has a width (e.g. approximately 12") that is greater than all other elongated solid sections 309 except the lowermost elongated solid section 309*b*, and the third lowest elongated solid section 309*d* has a width (e.g. approximately 10") between that of the second lowest elongated solid section 309*c* and the uppermost elongated solid section 309*a*.

In the embodiment of FIGS. 27-28, the tall band 300 is shown used with an exemplary separate lowermost band 270 having a width (e.g. approximately 19"-21") that is greater that the width of each solid section 309 of the tall band 300 and which is spaced downwardly from the tall band 300 a desired distance (e.g. approximately 5"). The illustrated holding container 10 may also include an exemplary separate uppermost band 274 having a width that is smaller than the width of each solid section 309 of the tall band 300. The embodiment of FIGS. 28-30 likewise includes a tall band 300 used with an exemplary separate lowermost band 270 having a width 272 (e.g. approximately 19"-21") that is greater that the width of each elongated solid section 309 of the tall band 300, and an exemplary separate uppermost band 274 having a width 276 (e.g. approximately 4") that is smaller than the width of each elongated solid section 309 of the tall band 300. Further, in this embodiment, the widths of the elongated solid sections 309 of the tall band 300 are graduated in an effort to provide sufficient support on the wall 12 based upon the expected load placed thereupon during use of the holding container 10 as follows: the uppermost elongated solid section 309*a* has a width (e.g. approximately 9") that is smaller than all the other elongated solid sections 309; the lowermost elongated solid section 309*b* has a width (e.g. approximately 16") that is greater than all the other elongated solid sections 309; the second lowest elongated solid section 309*c* has a width (e.g. approximately 14") that is greater than all other elongated solid sections 309 except the lowermost elongated solid section 309*b*; and the third and fourth lowermost elongated solid sections 309*d*, 309*e* each have a width (e.g. approximately 10") intermediate to the second lowermost elongated solid section 309*c* and the uppermost elongated solid section 309*a*. However, each of the solid sections 308 of each tall band 300 may have any other desired width, or may all possess the same width.

Referring back to FIGS. 23A-24A, when included, the cut-outs 304 may likewise have any desired dimensions. For example, the cut-outs 304 may be as large as possible to minimize the weight and size of the tall bands 300 while the tall band 300 still can provide the necessary load-bearing capacity and support to the wall 12 and/or other desired purposes. In the illustrated embodiment, the uppermost elongated cut-outs 305*a* each have a width (e.g. approximately 12") that is greater than the other elongated cut-outs 305 on the tall band 300; the lowermost elongated cut-outs 305*b* each have a width (e.g. approximately 9") that is less than the other elongated cut-outs 305 on the tall band 300; and the intermediate elongated cut-outs 305*c* each have a width (e.g. approximately 10") that is between the width of the other elongated cut-outs 305 on the tall band 300. In the embodiment of FIG. 28, the elongated cut-outs 305 on the two upper rows of cut-outs each have a width (e.g. approximately 12") that is greater than width (e.g. approximately 6") of the elongated cut-outs 305 on the two lower rows of cut-outs 305. However, each of the cut-outs 304 of each tall band 300 may have any other desired width, or may all possess the same width.

If desired, one or more of the exemplary tall bands 300 may include one or more hoisting attachments 318 useful for gripping the tall band 300 during manufacture, transport, installation and/or disassembly of the holding container 10. The hoisting attachments 318 may have any suitable form, configuration, location and operation. In this example, each hoisting attachment 318 includes a tab 319 extending from the upper edge 303 of the illustrated tall band section 280 and at least one attachment aperture 320 formed in the tab 319. The exemplary aperture 320 is configured to receive a gripping instrument, such as a tooth, hook, pin, clip or other mechanism extending from, or connected to, a lifting device (e.g. crane, wheel loader, other heavy equipment, winch, etc.) and the tab 319 is strong enough to allow the tall band section 280 to be lifted at one or more attachment apertures 320 and moved as desired.

Referring still to FIGS. 23A-24A, any desired number of hoisting attachments 318 may be included. In this embodiment, the tall band section 280 includes three spaced-apart hoisting attachments 318. However, more or less than three (e.g. 1, 2, 4 or more) hoisting attachments 318 may be provided at any location on the tall band 300 or tall band section 280. For example, one or more hoisting attachments 318 (e.g. six or more or less) may be spaced-apart on each tall band section 280 proximate to the upper edge 303 thereof. For another example, one or more hoisting attachments 318 (e.g. two or more) may be provided proximate to the upper and lower edges and each side edge of the tall band section 280. It should be noted that the other forms of horizontal braces 260 (e.g. bands 262, band sections 280) may, if desired, include hoisting attachments 318 similarly as described above and shown in the appended drawings with respect to the tall band 300.

Referring to FIG. 27, in some embodiments, the support system 22 may include one or more vertical braces 278 to assist in reinforcing the wall 12, provide a good fit between the panels 14 and the horizontal brace(s) 260 (e.g. tall band sections 280), other desired purpose or a combination thereof. The vertical braces 278 may have any suitable form, configuration and operation. In this example, each vertical braces 278 is a section of 2"×4" wood beam configured to be coupled to at least one of the panels 14 of each pair of adjacent interconnected panels 14 (e.g. along at least part of the outer side edge 44 of one of the panels 14) and sandwiched between the wall 12 and one or more horizontal braces 260 (e.g. tall band 300). In other embodiments, the vertical braces 278 may be used as load-bearing components or for another other purpose, and/or may be used instead of the horizontal braces 260 or not at all.

Referring back to FIG. 13A, the various components of the exemplary holding container 10 may be constructed of any suitable material or combination thereof, such as plastic. rubber, fiberglass, fiber-reinforced plastic, other synthetic or composite material, recycled rubber or other recycled material, and could include steel (such as for reinforcement), wood, steel-framed wood, aluminum, concrete, cementitious material, earth metals, other naturally occurring substances or other material. For example, at least approximately 10% (or more or less, such as at least 20%, 50%, 75%, etc.) of any combination of the panels 14, connectors (e.g. panel connectors 200, horizontally-extending connectors 260, vertical braces 278, etc.) and liquid-impermeable surface(s) 148 may be constructed of non-metallic material. If desired, all of components of the exemplary holding container 10 may be durable and weatherproof for sustained use and reuse. For example, some or all of the metallic parts of the holding container 10 may be constructed, or coated, with corrosion-resistant material (e.g. zinc), as is and becomes further known.

Referring now to FIGS. 1 & 13A, some embodiments of methods of forming a large-capacity holding container 10 will now be described. These methods include releasably interconnecting at least some of a plurality of upright, pre-formed, load-bearing panels 14 to form an at least partially curved, load-bearing first wall 12 around the perimeter of one or more storage area(s) 13 to contain the contents of the storage area(s) 13. If desired, the space or storage area(s) 13 enclosed by the wall 12 may be at least partially sealed with the use of at least one liquid-impermeable surface 148 (e.g. as described and shown elsewhere herein) or in any other suitable manner. If desired, a roof or other cover may be placed across the top of the wall 12, such as to seal off the storage area(s) 13 from precipitation, wind, dust, dirt, etc., or for any other purpose(s). In some embodiments, the large-capacity holding container 10 may take the form of a silo.

Referring still to FIGS. 1 & 13A, each panel 14 is originally formed flat and at last one among the width and the length of each panel 14 is under 102" (or more or less, e.g. under 96") in a non-load-bearing state. At least some of the panels 14 may flex into a curved shape during use of the holding container 10. Preferably, the panels 14 may be recycled (e.g. melted, ground, crushed, cut apart, etc.) to form recyclable panel material useful to form one or more new panels 14 (e.g. having the same properties, characteristics and capabilities as the plurality of panels 14). In some instances, the panels 14 may be recycled (e.g. melted, ground, crushed, cut apart, etc.) to form recyclable panel material useful to form one or more other types of desired components (e.g. having the same properties, characteristics and capabilities as the plurality of panels 14).

Still referring to FIGS. 1 & 13A, in many embodiments, the size and/or shape of the first wall 12 may be determined at least partially by the number of panels 14 interconnected to form the wall 12. In such instances, the size and/or shape of the wall 12 may be varied during formation of the wall 12 by varying the number of panels 14 used at the installation site or at different sites. In some embodiments, the first wall 12 may be disassembled and at least some of the disassembled panels 14 erected as one or more other walls 12 (e.g. at the same and/or other installation site(s)), such as in the same manner as shown and described elsewhere herein to serve as one or more other holding containers 10. The newly formed wall(s) 12/holding container(s) 10 may have a different size and/or shape and be capable of containing a different volume (at least 100,000 gallons of liquids, solids or a combination thereof) as compared to the volume of the first wall 12/holding container 10. Thus, in many instances, the same panels 14 may be reused time and again to form any desired quantity, size and configuration of holding containers 10.

Figure 34:
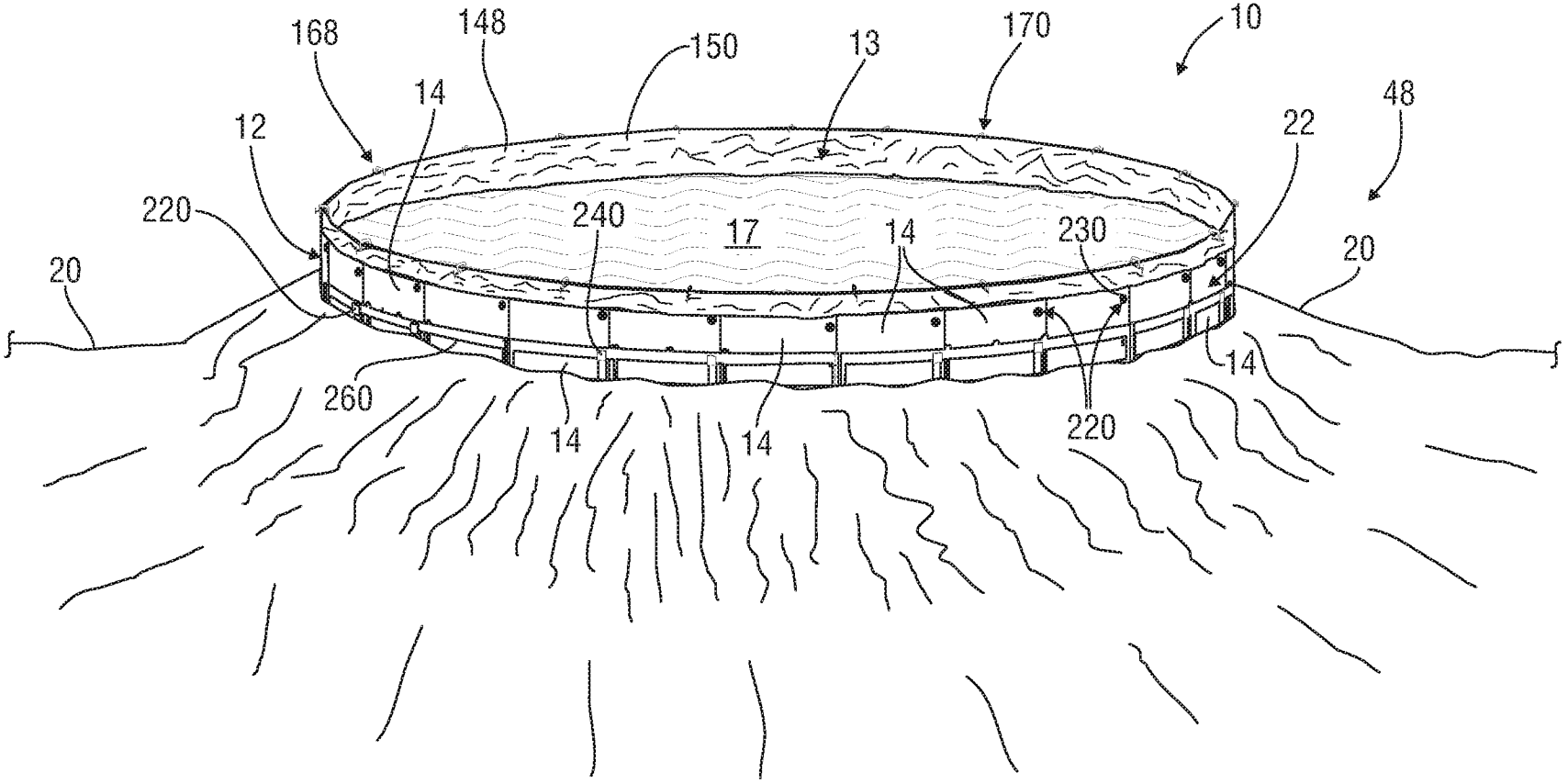
FIG. 34 is a perspective view of an exemplary large-capacity, modular, holding container buried at least partially underground in accordance with one or more embodiments of the present disclosure.

Referring now to FIG. 34, in at least some instances, the panels 14 may be at least partially buried underground and have a material construction (e.g. at least partially plastic) capable of resisting microbial and biological degredaton and degredation due to the alkalinity of the earth. In some at least partially underground installations, the use of various other components described and shown herein (e.g. horizontal braces 260, panel stands 140) may not be necessary or desirable, or the quantity, form and configuration thereof may be modified.

Figure 36:
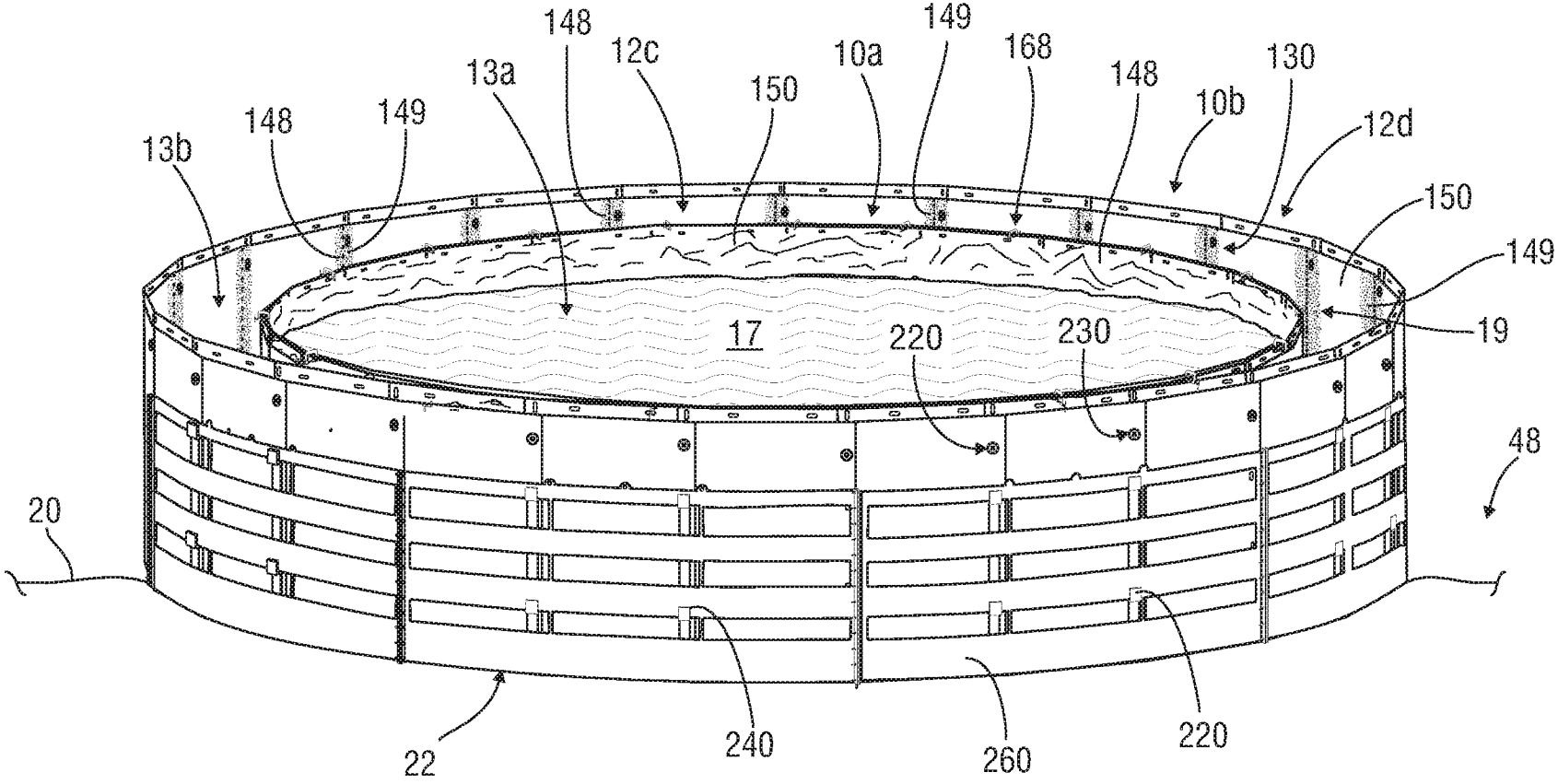
FIG. 36 is a perspective view of first and second nested exemplary large-capacity, modular, holding containers in accordance with one or more embodiments of the present disclosure.

Referring to FIG. 36, if desired, other among the plurality of panels 14 may be positioned and releasably interconnected in an upright orientation around the outer perimeter 19 of the first (inner) wall 12*c* to form an at least partially curved, load-bearing second (outer) wall 12*d* around the first wall 12*c* to form a "nested" pair of holding containers 10*a*, 10*b*. Nested large-scale holding containers 10 may be desirable, for example, for use with sensitive, hazardous or dangerous storage area contents, providing enhanced security, isolation or quarantine, providing a second layer of protection (e.g. storm protection, leakage protection, protection of the contents of the storage area 13 from contamination, etc.), any other purpose(s) or a combination thereof. Both walls 12*c*, 12*d* and holding containers 10*a*, 10*b* may have the same features and capabilities as described above and shown in the appended drawings for the wall 12 and container 10, the description of which is hereby incorporated by reference herein in its entirety. Each container 10*a*, 10*b* may have the same or different overall shape. The walls 12*c*, 12*d* may be spaced-apart or abutting, as desired. In some instances, more than two nested walls 12 (e.g. three, four or more) may be used, and/or one or more of the large-scale holding containers 10 of the present disclosure may be used in a nested configuration with other types of holding containers (e.g. storage tanks).

Referring to FIGS. 1, 2 & 4, if the panels 14 are re-usable for another purpose the first wall 10 may be disassembled and one or more of the panels 14 used for such other purpose. In the preferred embodiment, the disassembled panels 14 may be used as ground covers 26, such as described above. For example, at least some of the panels 14 may be laid at least partially horizontally on the ground as ground covers 26 to form a support surface 16 capable of supporting a desired weight (e.g. personnel, equipment and vehicles (e.g. bulldozers, bucket-loaders, water and fuel tanker trucks, semi-trailer trucks, etc.)) thereupon and moving thereacross.

Referring back to FIG. 1, some embodiments of assembling and installing a large-capacity holding container 10 will now be described. The methods may include preparation of the installation site 48. For example, the ground may be at least partially leveled and gravel, or other suitable material, placed on the ground where the exemplary panels 14 will rest to help the panels 14 stand up, provide a level surface and/or cushion for the panels 14, for any other desired purpose(s) or a combination thereof. If desired, one or more trenches, channels, recesses or depressions may be formed within which the panels 14 will be placed or erected. Any suitable lifting device (e.g. wheel loader, crane, winch, other heavy equipment, etc.) may be used to lift and position each panel 14 (e.g. upright and side-by-side) as desired. In some instances, the panels 14 may be moved with any of the components and/or techniques described and shown in U.S. Pat. Nos. 9,132,996, 7,370,452 and 9,297,124.

One or more of the exemplary erected panels 14 may be (e.g. temporarily) held upright in any desirable manner. In this embodiment, a panel stand 140 may be propped against the front face 27 and/or the rear face 29 of one or more of the panel(s) 14 to temporarily hold them upright. The panel stand 140, when included, may have any suitable form, configuration, components and operation. The illustrated panel stand 140 includes an angularly-oriented elongated body 144 and a biasing plate 146 at each end thereof. One of the exemplary biasing plates 146 is configured to rest upon the ground 20 and the other to be biased up against the front or rear face 27, 29 of one or more panels 14 to hold the panel(s) 14 upright. If desired, a panel stand 140 may be employed on both sides of the panel(s) 14 being held upright thereby. In the illustrated embodiment, panel stands 140 are used on both sides of the third, seventh, fourteenth and eighteen erected panels 14. For another example, a panel stand 140 may be used on each face 27, 29 of the first few panels 14 erected and any number of additional panels 14 spaced therefrom (e.g. at every sixth panel 14). For yet another example, approximately a dozen panel stands 140 (one panel stand 140 on each face 27, 29 of six different panels 14) may be used during assembly of the holding container 10. Further, in the present embodiment, at some point in the assembly of the exemplary holding container 10 (e.g. when the wall 12 has enough bend to stand upright), the panels 14 may stand upright as desired without the need for panel stands 140 and the panel stands 140 may be removed or left in place (e.g. in FIG. 13A, the panel stands 140 may be removed). However, any number and arrangement of panel stands 140 and/or other components useful to assist in holding the panels 14 upright may be used. Furthermore, in other embodiments or particular installation sites, the use of panel stands 140 or other components to (e.g. at least temporarily) hold the panels 14 upright may not be necessary or desirable (e.g. at some at least partially buried holding container 10 installations).

Still referring to FIG. 1, in the preferred embodiment, as each exemplary panel 14 is added to the wall 12, it is coupled to the panel 14 on one (either) end of the wall 12, such as with one or more of the panel connectors 200. In this embodiment, when the panel connectors 200 are bolts 206, the head 208 of the bolt 206 may be positioned on the inner side 12*a* of the wall 12 (e.g. FIG. 25) and at least one exemplary washer 230 sandwiched between the bolt head 208 and rear face 29 of the corresponding inside-facing panel 14. On the outer side 12*b* of the illustrated wall 12, either one or more washers 230, or an attachment bracket 240, may preferably be sandwiched between the panel connector 200 and/or an associated component (e.g. releasable lock 210) and the outer side 12*b* of the wall 12 (e.g. FIG. 25), or otherwise retained in the desired position. For example, an attachment bracket 240 may be coupled to the wall 12 at the desired elevation on the wall 12 for each horizontal brace 260 (e.g. as described above) at every other intersection of adjacent panels 14, and, if desired, one or more washers 230 may be used with all the other panel connectors 200 on the outer side 12*b* of the wall 12. However, additional intermediate plates 220 may be used. For example, one or more washers 230 may be used along with the attachment bracket(s) 240 on the outer side 12*b* of the wall 12. Further, in some embodiments, the bolt head 208 may be on the outer side 12*b* of the wall 12, or another type of pin 204 or panel connector 200 may be used to couple adjacent panels 14 together and/or support the horizontal braces 260. Thus, the present disclosure and appended claims are not limited to the above-described details of coupling of adjacent panels 14 and support of horizontal braces 260, except as otherwise as may be expressly recited and explicitly required in a particular claim hereof and only for such claim(s) and any claim(s) depending therefrom.

Still referring to the embodiment of FIG. 1, any desired number of exemplary panel connectors 200 may be used. For example, one panel connector 200 (e.g. with at least one intermediate plate 220 (e.g. washers 230) on each side of the wall 12) may be used to engage each adjacent pair of panels 14 at multiple (e.g. three or more or less) elevations to at least initially couple them together during installation of the wall 12. Ultimately, all the desired panel connectors 200 and intermediate plates 220 (e.g. washers 230 and attachment brackets 240) may be coupled to the panels 14 at this time or later. In many embodiments, panel connectors 200 are used at five (or more or less) different elevations on the wall 12 to couple each pair of adjacent panels 14 together. Further, a different number of panel connectors 200 may be used with different pairs of adjacent panels 14 on the same wall 12. Additionally, multiple panel connectors 200 (e.g. 2, 3, etc.) may be used at the same location (e.g. extending through the same receptacles 32) on the wall 12.

Figure 21:
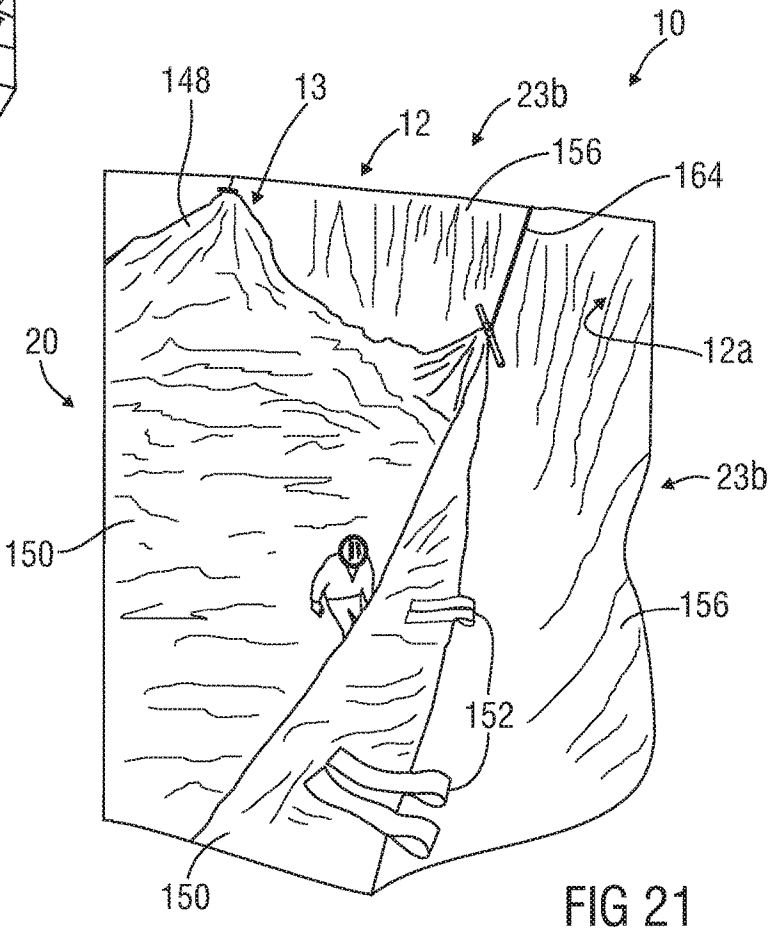
FIG. 21 is a partial front view of the installation of one or more exemplary liquid-impermeable surfaces in connection with an exemplary large-capacity holding container in accordance with one or more embodiments of the present disclosure.
Figure 20:
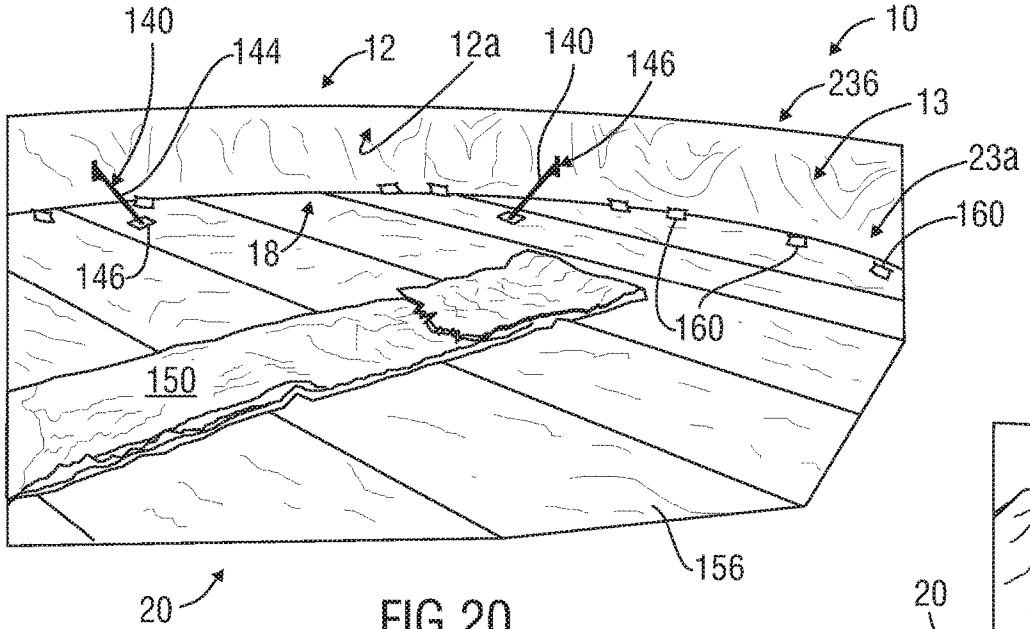
FIG. 20 is a partial front view of the installation of one or more exemplary protective layers in connection with an exemplary large-capacity holding container in accordance with one or more embodiments of the present disclosure.

Now referring to FIGS. 20-21, if desired, the space(s) enclosed by the wall 12 may be at least partially sealed, such as to form a sealed storage area 13, with at least one liquid-impermeable surface 148 or in any other suitable manner. In some instances, at least one liquid-impermeable surface 148 may be pre-formed as part of the panels 14, or integral therewith. Any suitable arrangement of one or more the liquid-impermeable surfaces 148 may be used. In this embodiment, the liquid-impermeable surface 148 includes one or more tank liners 150. For example, the liner(s) 150 may be extended across at least part of the area enclosed by the wall 12, extended up along the inner side 12*a* of the wall 12 and folded over the upper edge 23*b* thereof to form the sealed storage area 13 and contain the contents thereof. If desired, before the tank liner(s) 150 are placed around the storage area 13 (or one or more portions thereof), at least one protective layer 156 may first be provided, such as to assist in protecting the tank liner(s) 150 from being damaged (e.g. tearing), snagged or undesirably deformed by the substrate (e.g. underlying rocks, debris or terrain) or otherwise due to contact with the substrate 20 and/or other desired purposes. For example, the protective layer(s) 156 may be laid at least partially across the area enclosed by the wall 12, extended and up along the inner side 12*a* of the wall 12 and folded over the upper edge 23*b* thereof. In some embodiments, only one or the other, or neither, of the tank liner 150 and protective layer(s) 156 may be used.

The tank liner(s) 150 and protective layer(s) 156, when included, may have any suitable form, construction, configuration and operation. For example, the tank liner 150 may be a custom designed or commercially-available, liquid impermeable, geotextile or holding container liner (e.g. 40 mil. thick polyethylene) for the desired storage capacity of the holding container 10 (e.g. 20,000 barrel liner, 40,000 barrel liner, 60,000 barrel liner, etc.). The protective layer 156 may, for example, be a custom designed or commercially-available liner constructed of felt, non-woven or other geotextile or other materials. In the preferred embodiment, one or more dimensions of the tank liner 150 and/or protective layer 156 may be slightly larger than the size of the holding container 10, such as to accommodate uneven substrate, provide slack in the liner 150 and/or protective layer 156, for any other desired purpose(s) or a combination thereof.

Referring still to FIGS. 20-21, the tank liner(s) 150 and protective layer(s) 156, when included, may be laid in any suitable manner. For example, ladders may be placed on the outside and inside of the wall 12 to allow personnel to enter the storage area(s) 13. Once personnel are inside the area enclosed by the wall 12, the exemplary protective layer 156 may be manually extended across the area enclosed by the wall 12, extended up along the inner side 12*a* of the wall 12 and folded over the upper edge 23*b* thereof to form the sealed storage area 13. In this embodiment, ropes or other objects may be attached to the edge of the protective layer 156 and thrown over the wall 12 to allow personnel on the outside of the wall 12 to pull the protective layer 156 up and over the upper edge 23*b* of the wall 12 as desired. If multiple overlapping protective layers 156 are used, the above process may be repeated for each layer 156. During this process, the exemplary panel stands 140 on the inside of the wall 12 may be removed and, if desired, replaced over the protective layer 156. Weights, such as sandbags 160, may be placed on the ground 20 atop the illustrated protective layer 156 along at least part of the lower edge 23*b* of the wall 12 to help prevent the contents (e.g. liquid) that will be placed in the storage area 13 from being undesirably pushed under the wall 12, such as by the weight, pressure or load of the contents, assist in directing the load of the contents upwardly against the wall 12, for any other desired purpose(s) or a combination thereof.

In this embodiment, the same process may be then performed for the tank liner(s) 150. For example, the exemplary tank liner 150 may be manually spread out across the area and the protective layer(s) 156 inside the wall 12, extended up along the inner side 12*a* of the wall 12 and folded over the upper edge 23*b* thereof to form the sealed storage area 13. In this embodiment, ropes 164, or other objects, may be attached to the edge of the tank liner 150 (e.g. at loops 152) and thrown over the wall 12 to allow personnel on the outside of the wall 12 to pull the liner 150 up and over the upper edge 23*b* of the wall 12 as desired. If multiple overlapping tank liners 150 are used, the above process may be repeated for each liner 150. During this process, the exemplary panel stands 140 on the inside of the wall 12 may be removed and, if desired, replaced over the liner 150. Weights, such as sandbags 160, may also be placed atop the illustrated tank liner 150 along at least part of the lower edge 23*b* of the wall 12. In this embodiment, weights, such as sandbags 160, are preferably placed around the entire inside perimeter 18 of the wall 12, whether over the protective layer 156 or tank liner 150.

Referring now to FIG. 24A-B, the tank liner 150 and/or protective layer 156, when included, may be releasably secured to the wall 12 in any suitable manner. For example, one or more releasable clips 168 may be engaged over the tank liner(s) 150 at the upper edge 23*b* of the wall 12 to secure the liner(s) 150 (and protective layer(s) 156) to the wall 12. However, in other embodiments, the tank liners 150 and/or protective layers 156 may be secured to the wall 12 or other component in any other suitable manner or not secured to the wall 12.

Figure 32A:
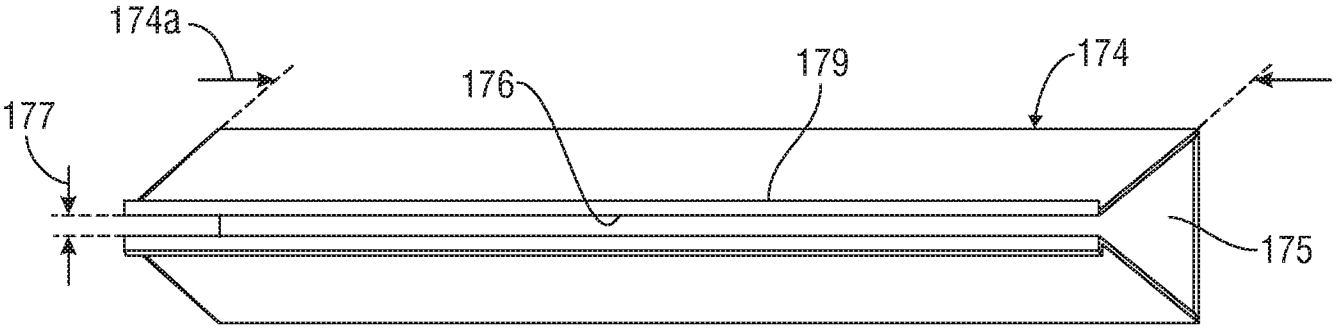
FIG. 32A is bottom view of an exemplary releasable clip useful for temporarily coupling one or more liquid-impermeable surfaces or other components to the exemplary large-capacity, modular, holding container wall in accordance with one or more embodiments of the present disclosure.
Figure 32B:
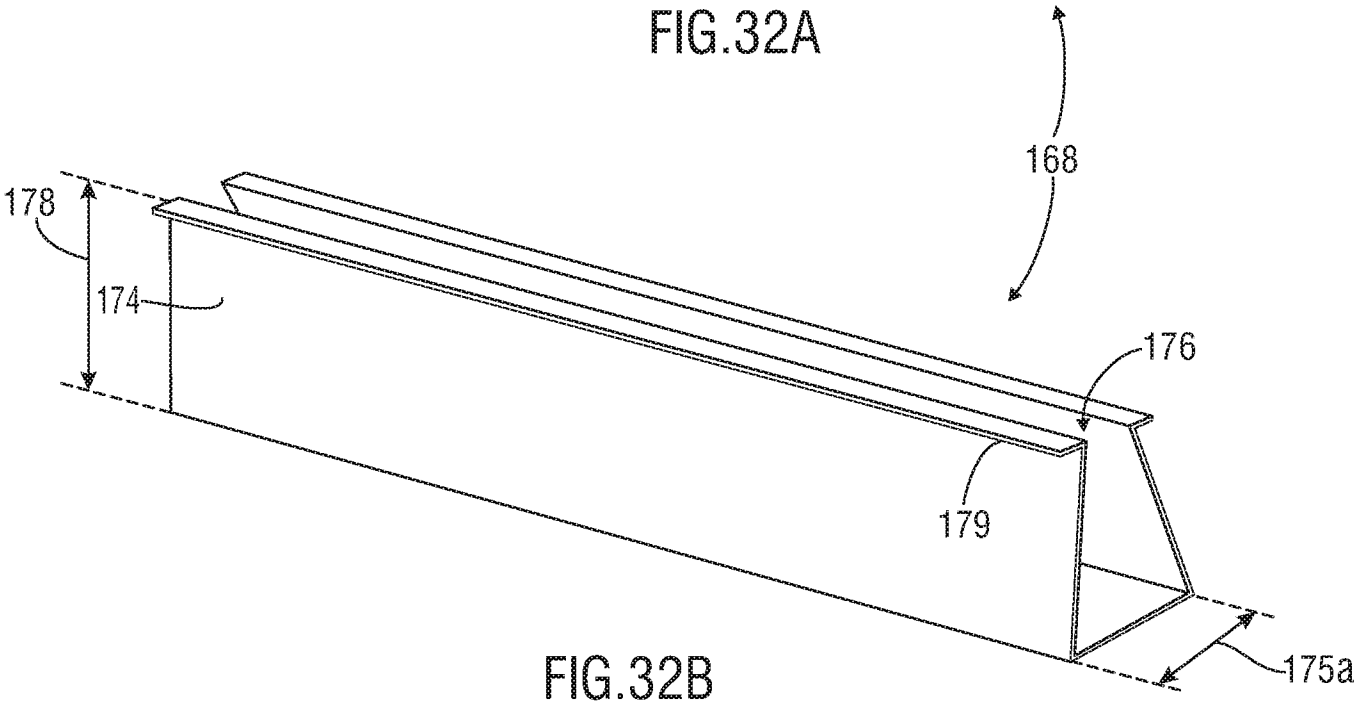
FIG. 32B is perspective view of the exemplary releasable clip of FIG. 32A.

When included, the releasable clips 168 may have any desired form, configuration and operation. In this embodiment, each releasable clip 168 is a C-clamp 170 having a threaded gripper 172 that is selectively tightenable down to the wall 12 over the liner(s) 150 and protective layer(s) 156 as desired. For another example, the releasable clip 168 of FIGS. 32A-B is a friction clip 174 configured to be pressed or hammered down (onto the upper edge 23*b* of the wall 12 over the liner 150 and protective layer 156). The exemplary friction clip 174 may have any suitable form, construction, configuration and operation. For example, the length 174*a* of the friction clip 174 may be approximately 2'-3', or more or less. For another example, the mouth 176 of the friction clip 174 may have a width 177 that is smaller than the width 175*a* of the base 175 of the friction clip 174 and the thickness of the upper edge 23*b* of the wall 12 (e.g. FIG. 1), so that the friction clip 174 will expand and contract into gripping engagement with the wall 12, but allow the tank liner 150 and protective layer 156 to be able to flex, shift or move without tearing or breaking, or other desired purpose. In the preferred embodiment, the thickness of the upper edge 23*b* of the exemplary wall 12 is approximately 2", the width 175*a* of the base 175 of the exemplary friction clip 174 may be approximately 2"-3" and the width 177 of the mouth 176 of the friction clip 174 may be approximately 1.0"-1.5". For another example, the friction clip 174 may have a height 178 (e.g. approximately 6"-8") that is sufficient to ensure the friction clip 174 securely engages the wall 12. If desired, the edges 179 of the mouth 176 of the exemplary friction clip 174 may be flared outwardly to prevent the tank liner 150 (and/or other component(s)) from catching or snagging on the friction clip 174. When included, the friction clip 174 may have any desired thickness and material construction. In this embodiment, the friction clip 174 is constructed of ⅛"-¼" thick steel so the clip 174 has the desired gripping strength and flexibility. In other embodiment, the releasable clips 168 may be integral to the panels 14 and/or liquid-impermeable surfaces 148 (and/or protective layers 156). In yet other embodiments, releasable clips 168 may not be necessary or desirable.

Referring back to FIGS. 13A-18B, the exemplary horizontal braces 260 are preferably placed on the corresponding attachment brackets 240 around the outer perimeter 19 of the wall 12 and assembled, such as described above. If desired, as shown in FIG. 27, for example, one or more vertical braces 278 may be coupled to the wall 12 and sandwiched between the wall 12 and one or more horizontal braces 260 (e.g. tall band 300) to assist in providing a good fit of the panels 14 and the horizontal brace(s) 260 or other desired purpose.

The holding container 10 may be filled with the desired contents in any suitable manner. For example, when the contents of the holding container 10 include liquid 17, the holding container 10 may be filled with the liquid using one or more fill tubes 190 in fluid communication with the storage area(s) 13. The fill tube(s) 190 may have any suitable form, configuration and arrangement. In this example, two fill tubes 190 are provided, each including a hose 192 (or series of interconnected hoses) coupled to a (e.g. plastic) U-shaped tube 194 hung over the upper edge 23*b* of the wall 12. In this example, the inner diameter of the hoses 192 and U-shaped tube 194 are approximately 8"-12" and each U-shaped tube 194 is held in position at the upper edge 23*b* of the wall 12 with a horizontal member 196 (e.g. section of 2"×4" wood) coupled thereto. If desired, the fill tube(s) 190 may also be used to remove liquid from the storage area 13, or at least one fill tube 190 can be dedicated to each process (fill and drain). In some embodiments, the exemplary container installation process may not require substantial time (e.g. approximately 10-14 hours to install a wall 12 with fifty panels 14).

The exemplary holding container 10 may, if desired, be emptied and disassembled by reversing the above installation sequence, reloaded on trucks for storage or transport to another location for construction of another holding container 10 of the same or a different size and/or configuration or the panels 14 used for a different purpose (e.g. as ground covers 26). Thus, the holding container 10 is easy to install, disassemble, transport, store and reuse.

The exemplary large-capacity holding container 10 of the present disclosure may have any one or more of the features described or shown in this patent including, without limitation, one or more of the following exemplary features. The holding container 10 may be modular, heavy duty, durable, weather-resistant, portable, reusable, temporary, semi-permanent and/or permanent, configurable in any desired shape and size, easy to install and disassemble, transport and store, constructed of panels and other components (e.g. horizontally-extending connectors, vertical joining members) having a material construction (e.g. less than 50% metallic), size, shape, weight and structure that provides advantages (e.g. are smaller, lighter, less expensive to manufacture and/or easier to handle) as compared to other large-capacity holding containers (e.g. steel-walled tanks) having similar load-bearing and storage capacities, uses panels that are recyclable and/or useful for other purposes (e.g. ground covers). In many embodiments, all the components of the exemplary large-capacity holding container 10 may fit and be transportable on a minimum number of transporters (e.g. standard flatbed or enclosed box trailers each having a maximum load capacity of up to approximately 48,000 lbs. and load dimensions of up to approximately 8.5'×approximately 48'), avoiding the cost, effort, time-delay and restrictions caused by permitted-load transportation and/or the necessary use of special transport vehicles (as required for other large-capacity storage solutions). For example, in some embodiments, if the exemplary large-capacity holding container 10 includes fifty panels 14 for forming an approximate 250' circumference approximate circle with an approximate 110' diameter to provide a storage capacity of approximately 22,000 barrels (924,000 gallons, e.g. when the holding container 10 is filled up to approximately 12' high on the wall 12), all necessary components may fit on two non-permitted, standard flatbed or enclosed box trailers, which is substantially fewer than other commercially available large-capacity holding container solutions. For another example, an exemplary holding container 10 formed with ninety of the exemplary panels 14 and having a storage capacity up to approximately 66,000 barrels (2,772,000 gallons) may be transportable to the installation side as a non-permitted load (e.g. via 3-4 standard flatbed or enclosed box trailers). In various embodiments, many or all of the components of the holding container 10 other than the panels 14 may be procured or fabricated locally, requiring only the panels 14 to be transported (e.g. on one or two standard flatbed or enclosed box trailers) to the installation site.

Preferred embodiments of the present disclosure thus offer advantages over the prior art and are well adapted to carry out one or more of the objects of this disclosure. However, the present invention does not require each of the components and acts described above and is in no way limited to the above-described embodiments or methods of operation. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and/or claims.

The methods described above or claimed herein and any other methods which may fall within the scope of the appended claims can be performed in any desired or suitable order and are not necessarily limited to any sequence described herein or as may be listed in the appended claims. Further, the methods of the present disclosure do not necessarily require use of the particular embodiments shown and described herein, but are equally applicable with any other suitable structure, form and configuration of components.

While exemplary embodiments have been shown and described, many variations, modifications and/or changes of the system, apparatus and methods of the present disclosure, such as in the components, details of construction and operation, arrangement of parts and/or methods of use, are possible, contemplated by the patent applicant(s) hereof, within the scope of any appended claims, and may be made and used by one of ordinary skill in the art without departing from the spirit, teachings and scope of this disclosure and any appended claims. Thus, all matter herein set forth or shown in the accompanying drawings should be interpreted as illustrative, and the scope of the disclosure and any appended claims should not be limited to the embodiments described and shown herein.

The invention claimed is:

1. A holding container including a load-bearing wall extending around a perimeter of at least one storage area, the holding container comprising:

a plurality of pre-formed, releasably interlocking, load-bearing flat panels configured to form the load-bearing wall, each panel configured to be bent to form a portion of the load-bearing wall and wherein each panel is configured to at least partially overlap with an adjacent panel when forming the portion of the load-bearing wall, wherein the load-bearing wall is at least partially curved, and wherein each panel comprises at least one lip having a lip thickness less than a main body thickness of a respective panel and the at least one lip is configured to overlap with at least one lip of an adjacent panel to form an overlapped lip thickness substantially equal to the main body thickness of the panel, wherein each lip comprises at least one receptacle and, when two panels overlap, a receptacle of each panel aligns with a respective receptacle of the adjacent panel and the aligned receptacles are configured to receive a panel connector to fixedly couple the two panels together.

2. The holding container of claim 1, wherein:

the load-bearing wall is a continuous wall, the shape of the continuous wall including at least three distinct, at least partially linear, sides and a corner between each side, and at least one of the corners is curvilinear.

3. The holding container of claim 1, wherein each panel is elastic and able to flex into a curved shape during use of the holding container.

4. The holding container of claim 1, wherein:

the load-bearing wall and the at least one storage area are buried at least partially underground, and the material composition of the panels renders the panels resistant to microbial and biological degradation and degradation due to the alkalinity of the earth.

5. The holding container of claim 1, wherein:

when the panels are interlocked, each panel overlaps each adjacent panel across at least 5% of the smaller of its width and length.

6. The holding container of claim 1, wherein the panels are configured to be coupled together in a manner that allows each panel to move side-to-side and up-and-down at least one of independently and in unison with one or more other panels in response to at least one of variations in a substrate below the panels and loads applied to the panels by contents of the at least one storage area without damaging or disengaging the panels or degrading the strength characteristics of the panels or the ability of the holding container to contain the contents of the at least one storage area.

7. The holding container of claim 1, further including:

at least one liquid-impermeable surface disposed at least partially around the at least one storage area inside the load-bearing wall and configured to prevent the contents of the at least one storage area from escaping out of the holding container, wherein the at least one liquid-impermeable surface includes at least one among the group consisting of one or more liners, geotextiles, coatings, and spongy materials.

8. The holding container of claim 7, wherein:

when the panels are interlocked to form the load-bearing wall, at least one joint is formed between adjacent interlocked panels, and the at least one liquid-impermeable surface extends only along the formed joints on the inside of the load-bearing wall.

9. The holding container of claim 1, wherein:

the holding container is configured to be installed at a container installation site, and the size of the holding container is configured to be variable during installation thereof at the container installation site in increments of one or more panels.

10. The holding container of claim 1, wherein the panels are at least partially hollow.

11. The holding container of claim 1, wherein the panels are configured to be modular and reusable to form at least one of partially curved, load-bearing, holding container walls having different sizes and containment capacities and holding containers having different sizes and containment capacities.

* * * * *